US012773052B1

(12) United States Patent
Bickel et al.

(10) Patent No.: US 12,773,052 B1
(45) Date of Patent: Oct. 27, 2026

(54) HIGH CHAIR APPARATUS WITH ONE WAY ENGAGEMENT

(71) Applicant: Regalo International, LLC, Burnsville, MN (US)

(72) Inventors: Shannon R. Bickel, Lakeville, MN (US); Timothy C. Daggy, Shakopee, MN (US); William D. Butterfield, River Falls, WI (US)

(73) Assignee: Regalo International, LLC, Burnsville, MN (US)

( * ) Notice: Subject to any disclaimer, the term of this patent is extended or adjusted under 35 U.S.C. 154(b) by 81 days.

(21) Appl. No.: 18/412,528

(22) Filed: Jan. 13, 2024

Related U.S. Application Data

(60) Provisional application No. 63/439,843, filed on Jan. 18, 2023.

(51) Int. Cl.
*A47D 1/00* (2006.01)

(52) U.S. Cl.
CPC ..... *A47D 1/0085* (2017.05); *A47D 1/006* (2013.01)

(58) Field of Classification Search
CPC ..... A47D 1/0085; A47D 1/006
See application file for complete search history.

(56) References Cited

U.S. PATENT DOCUMENTS 5,810,432 A * 9/1998 Haut ..... A47D 1/023 297/467
5,951,102 A * 9/1999 Poulson ..... A47D 1/023 297/440.16
6,692,070 B1 * 2/2004 Hou ..... A47D 1/023 297/149
7,066,542 B2 * 6/2006 Wang ..... A47D 1/0081 297/364
7,422,276 B2 9/2008 Flannery
7,591,506 B2 9/2009 Flannery
8,038,207 B2 10/2011 Flannery
8,091,965 B2 1/2012 Flannery et al.
8,267,473 B2 9/2012 Flannery et al.
9,565,929 B2 2/2017 Flannery et al.
9,955,811 B2 5/2018 Flannery et al.
10,653,250 B1 5/2020 Flannery et al.
10,763,450 B2 9/2020 Xin et al.
10,966,543 B1 4/2021 Flannery et al.
11,019,939 B1 6/2021 Flannery et al.
11,166,570 B1 11/2021 Flannery et al.
11,291,311 B1 4/2022 Flannery et al.
11,529,001 B1 12/2022 Flannery et al.
(Continued)

*Primary Examiner* — David R Dunn
*Assistant Examiner* — Jessica Kathryn Thompson

(57) ABSTRACT

A high chair having right and left side mechanisms for engaging a tray to a receptacle, where each of the right and left side mechanisms have an inner portion and an outer portion. The inner portion includes a slide and the outer portion includes a ramp and a slotted tab that generate a snap when engagement with the ramp is complete. The high chair further includes a foot rest that extends between first and straight second legs, that is spaced from and independent of the tray, that receives each of the first and second legs, and that slides minimally upwardly and downwardly on the first and second straight legs by virtue of an oblique angle between axes of leg receivers integral with the foot rest. Further disclosed is a method for engaging a tray to a high chair receptacle.

17 Claims, 23 Drawing Sheets

(56) References Cited

U.S. PATENT DOCUMENTS

| | | | | |
|---|---|---|---|---|
| 11,559,145 | B1 | 1/2023 | Flannery et al. | |
| 11,666,157 | B1 | 6/2023 | Flannery et al. | |
| 2005/0006930 | A1* | 1/2005 | Nolan | A47D 1/002 297/153 |
| 2009/0206639 | A1* | 8/2009 | Bearup | A47D 1/0085 297/151 |
| 2011/0074187 | A1* | 3/2011 | Zhong | A47D 1/103 297/130 |
| 2020/0352349 | A1* | 11/2020 | Tuckey | A47D 1/04 |
| 2023/0068417 | A1* | 3/2023 | Pacella | A47D 1/002 |

* cited by examiner

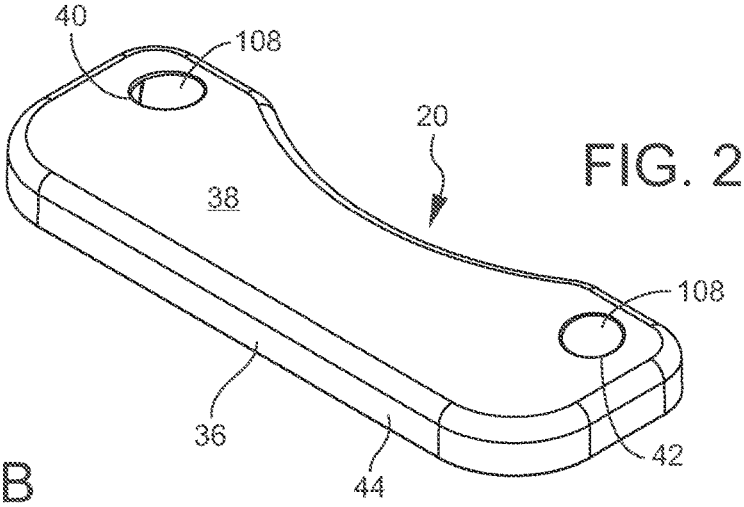
FIG. 21A
FIG. 21B
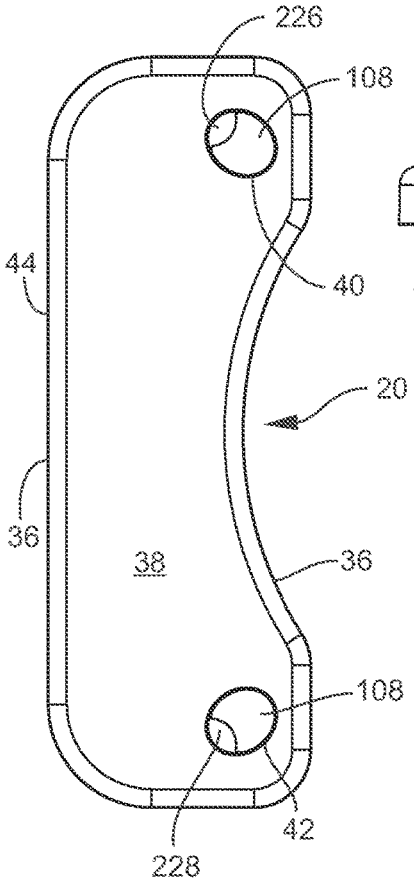
FIG. 21C
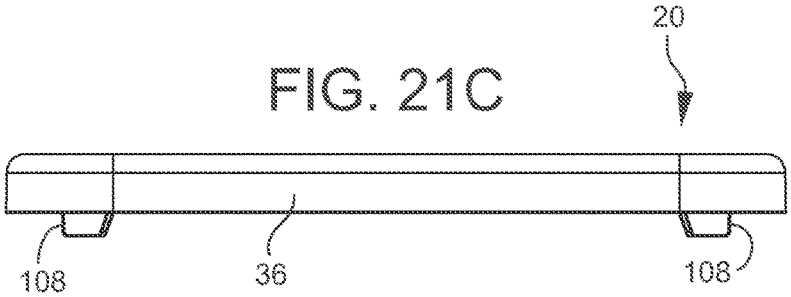
FIG. 21D
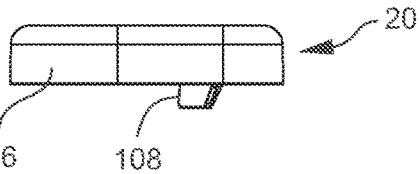
FIG. 21E
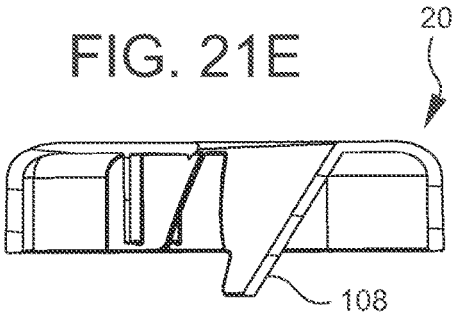

HIGH CHAIR APPARATUS WITH ONE WAY ENGAGEMENT

This application claims the benefit under 35 U.S.C. 119(e) of U.S. Provisional Patent Application No. 63/439,843 filed Jan. 18, 2023, which application is hereby incorporated by reference in its entirety into this application.

FIELD OF THE INVENTION

The present invention relates to a high chair apparatus, particularly to a high chair apparatus with a tray, and specifically to a high chair tray having a one way engagement with the high chair apparatus.

BACKGROUND OF THE INVENTION

A high chair may have a number of safety features. These features include a harness or strap that is engaged about the child, such as about the torso of a child, a crotch restraint or tower extending upwardly between the legs of a child, and the tray itself. It is therefore incumbent upon the caretaker to pay attention to the harness, tower, and tray.

The tray especially is subject to repeated use. First a tray is removed from a high chair. Then a child is lifted into the high chair. Then the tray is placed back on the high chair. Then the child is served and may eat, or eat and play, or play and not eat. Then the tray is removed from the high chair. Then the child is lifted down from the high chair. Then the tray is placed back on the now empty high chair. Thus during one meal itself one tray connection is operated four times. Such a process is likely repeated three times a day for breakfast, lunch, and dinner such that one tray connection is operated a dozen times per day. If a tray has two connections, then two dozen mechanical tray operations are performed daily and, hopefully, safely.

SUMMARY OF THE INVENTION

A feature of the present invention is the provision in a high chair apparatus, of a one way tray engagement when the tray is engaged to the high chair. The tray may not be engaged to the high chair by a downward motion, or an upward motion, or a sideway motion, or a motion where the tray is drawn frontwardly in a direction from the back of the high chair to a front of the high chair. Instead, the tray must be slid in a direction from the front of the high chair to the back of the high chair, whereupon tabs or ears of the tray snap resiliently onto ramps on arm rests of the high chair.

Another feature of the present invention is the provision in a high chair apparatus, of a one way tray disengagement when the tray is removed from the high chair. After resiliently flexing the ears outwardly to disengage the ears from their respective ramps, the tray may not be disengaged from the high chair by a downward motion, or an upward motion, or a sideway motion, or a motion where the tray is drawn rearwardly in a direction from a front of the high chair to a back of the high chair. Instead, after resiliently flexing the ears or tabs outwardly to disengage the ears or tabs from their respective ramps, the tray must be slid in a direction from the back of the high chair to the front of the high chair.

Another feature of the present invention is the provision in a high chair apparatus, of a receptacle for a child, where the receptacle includes a seat portion, a back portion, a left side portion, and a right side portion.

Another feature of the present invention is the provision in a high chair apparatus, of legs depending from the receptacle for supporting the receptacle relative to a floor or ground portion, where each of the legs includes an upper portion and a lower portion.

Another feature of the present invention is the provision in a high chair apparatus, of a tray removably engaged to the receptacle, where the tray includes a front and a rear.

Another feature of the present invention is the provision in a high chair apparatus, of left and right engagement mechanisms between the tray and the receptacle, where the left engagement mechanism is disposed between the tray and the left side portion of the receptacle, and where the right engagement mechanism is disposed between the tray and the right side portion of the receptacle.

Another feature of the present invention is the provision in a high chair apparatus, of a receiver integral and one-piece with the receptacle, where the receiver includes an open front end.

Another feature of the present invention is the provision in a high chair apparatus, of a ramp engaged to the receptacle, where the ramp is integral and one-piece with the receptacle, where the ramp extends outwardly from the receptacle, where the ramp includes a ramped outer edge, and where the ramp further includes a rear end.

Another feature of the present invention is the provision in a high chair apparatus, of an extension engaged to the tray, where the extension extends in a direction from the rear of the tray to the front of the tray, where the extension includes a distal end and a proximal end, where the distal end of the extension is engaged to the tray, where the proximal end of the extension is spaced from the tray, where the distal end of the extension is closer to the rear of the tray than is the proximal end of the extension.

Another feature of the present invention is the provision in a high chair apparatus, of a tab resiliently engaged to the tray, where the tab extends downwardly and outwardly from the tray when the tab is unflexed, where the tab extends obliquely from the tray when the tab is unflexed, where the tab extends longitudinally in a direction from the rear of the tray to the front of the tray, where the tab includes a slot, where the slot is a through slot, and where the slot extends laterally through the tab.

Another feature of the present invention is the provision in a high chair apparatus, of the extension of the tray slideably and removably engaging the receiver of the receptacle.

Another feature of the present invention is the provision in a high chair apparatus, of the tab of the tray slideably, resiliently, and removably engaging the ramp of the receptacle when the extension of the tray slides into the receiver of the receptacle and the slot receives the ramp.

Another feature of the present invention is the provision in a high chair apparatus, of the high chair apparatus having structure to deny access of the ramp to the slot unless the extension is in the receiver or unless an integrity of said structure is destroyed.

Another feature of the present invention is the provision in a high chair apparatus, of the tab including a bottommost tab edge, where the extension includes a bottommost extension edge, and where the bottommost extension edge is disposed higher than the bottommost tab edge.

Another feature of the present invention is the provision in a high chair apparatus, of the extension including a frontmost end, where the tab includes a rearmost end, and where the frontmost end of the extension is disposed rearwardly of the rearmost end of the tab.

Another feature of the present invention is the provision in a high chair apparatus, of the left side portion of the receptacle including a left arm rest, of the right side portion of the receptacle including a right arm rest, where the receiver of the left engagement mechanism is adjacent to the left arm rest, and where the receiver of the right engagement mechanism is adjacent to the right arm rest.

Another feature of the present invention is the provision in a high chair apparatus, of each of the left and right sides of the receptacle including an arm rest having a frontmost U-shaped edge, of a longitudinally extending rib depending from the arm rest, of a laterally extending rib extending from the arm rest and engaged to the longitudinally extending rib, and of the extension engaging the frontmost U-shaped edge and longitudinally extending rib when the tab is engaged to the ramp.

Another feature of the present invention is the provision in a high chair apparatus, of the slot being defined in part by a slot front edge, where the slot front edge engages the rear end of the ramp when the tray is fully engaged to the receptacle.

Another feature of the present invention is the provision in a high chair apparatus, of the tab including a distal portion and a proximal portion, and where the distal portion of the extension is closer to the rear portion of the tray than proximal portion of the tab.

Another feature of the present invention is the provision in a high chair apparatus, of the receiver having a proximal portion and a distal portion, and where the rear end of the ramp is closer to the back portion of the receptacle than is the proximal portion of the receiver.

Another feature of the present invention is the provision in a high chair apparatus, of the ramp including a distal portion and a proximal portion, and where the ramp outer edge tapers outwardly and rearwardly from the proximal portion.

Another feature of the present invention is the provision in a high chair apparatus, of the tab being resiliently bendable outwardly.

Another feature of the present invention is the provision in a high chair apparatus, of the tab being resiliently bendable outwardly when the extension is inserted into the receiver, where the tab is resiliently bent outwardly when engaged by the ramp.

Another feature of the present invention is the provision in a high chair apparatus, of a longitudinal length of the slot being greater than a longitudinal length of the ramp such that the tab resiliently snaps back to an unflexed position when the slot receives the ramp to indicate audibly that the tab has fully engaged the ramp.

Another feature of the present invention is the provision in a high chair apparatus, of the ramp including a floor, a first laterally extending rib, and a second laterally extending rib, where the floor includes the ramped outer edge, where the first laterally extending rib extends from the floor of the ramp to the receptacle, and where the second laterally extending rib extends from the floor of the ramp to the receptacle, and where each of the first and second laterally extending ribs is receivable in the slot.

Another feature of the present invention is the provision in a high chair apparatus, of the tray including a periphery having a left side portion and a right side portion, where each of the left side portion and right side portion extends downwardly and outwardly, and where each of the left side portion and right side portion includes a bottommost edge portion, of the slot being defined in part by an uppermost edge portion and a lowermost edge portion, and of the lowermost edge portion of the slot being below the bottommost edge portion of each of the left side portion and right side portion of the periphery.

Another feature of the present invention is the provision in a high chair apparatus, of the tray including a periphery having a left side portion and a right side portion, where each of the left side portion and right side portion of the periphery extends downwardly and outwardly in a respective plane, of the extension of the left engagement mechanism being disposed inside of the periphery, of the extension of the right engagement mechanism being disposed inside of the periphery, of the tab of the left side portion of the periphery extending downwardly and outwardly in the plane of the left side portion of the periphery, and of the tab of the right side portion of the periphery extending downwardly and outwardly in the plane of the right side portion of the periphery.

Another feature of the present invention is the provision in a high chair apparatus, of the receptacle including an arm rest portion having a frontmost portion, where the open front end of the receiver is disposed at the frontmost portion of the arm rest, where the open front end of the receiver defines an entrance of the receiver for the extension, of the ramp being on the arm rest portion and extending outwardly therefrom, of the receiver having an axis, where the axis of the receiver extends rearwardly and inside of the arm rest, where the ramp is on an outside of the arm rest, of the ramp including a frontmost end opposite of the rear end of the ramp, of a distance from the frontmost end of the ramp to the entrance of the receiver being a first distance, of the extension having a frontmost end and the tab having a rearmost end, of a distance from the frontmost end of the extension to the rearmost end of the tab being a second distance, and of the second distance being less than the first distance such that the frontmost end of the extension engages the entrance prior to the slot engaging the ramp.

Another feature of the present invention is the provision in a high chair apparatus, of a receptacle for a child, where the receptacle includes a seat portion, a back portion, a left side portion, and a right side portion, of a tray removably engaged to the receptacle, where the tray generally defines a first plane, of first, second, third, and fourth legs depending from the receptacle for supporting the receptacle relative to a floor or ground portion, where each of the first, second, third, and fourth legs include an upper portion and a lower portion, of a foot rest engaged to first and second legs, where the foot rest extends to and between the first and second legs, where the foot rest generally defines a second plane parallel to the first plane generally defined by the tray, where the foot rest includes a first through opening for receiving the first leg, where the foot rest includes a second through opening for receiving the second leg, where the first through opening defines a first axis, where the second through opening defines a second axis, where the first axis is oblique relative to the second plane, where the second axis is oblique relative to the second plane, and where the first and second axes taper away from each other.

Another feature of the present invention is the provision in a high chair apparatus, of the first through opening including a first cylinder having the first axis and where the second through opening includes a second cylinder having the second axis such that 1) when the foot rest is pushed downwardly outer portions of the first and second cylinders come under pressure from the first and second legs thereby limiting downward movement and 2) when the foot rest is pushed upwardly inner portions of the first and second cylinders come under pressure from the first and second legs thereby limiting upward movement of the foot rest.

Another feature of the present invention is the provision in a high chair apparatus, of the foot rest being spaced from the tray at a first distance, where the first distance is determined by a straight line distance between the first and second axis.

Another feature of the present invention is the provision in a high chair apparatus, of a method for engaging a tray to a high chair receptacle, where the high chair receptacle includes a left receiver having a straight axis and a right receiver having a straight axis, where the tray includes a left extension having a straight axis and a right extension having a straight axis, where the high chair receptacle further includes a left ramp and a right ramp, and where the tray further includes a left tab with a slot and a right tab with a slot.

Another feature of the present invention is the provision in a method for engaging a tray to a high chair receptacle, of the step of making the straight axis of the left extension co-axial with the straight axis of the left receiver and the straight axis of the right extension co-axial with the straight axis of the right receiver.

Another feature of the present invention is the provision in a method for engaging a tray to a high chair receptacle, of the step of sliding the left extension into the left receiver and the right extension into the right receiver.

Another feature of the present invention is the provision in a method for engaging a tray to a high chair receptacle, of the step of pushing the left tab over the left ramp such that the left ramp receives the slot of the left tab and sliding the right tab over the right ramp such that the right ramp receives the slot of the right tab.

Another feature of the present invention is the provision in a method for engaging a tray to a high chair receptacle, of the steps of making and sliding being necessary precursor steps to the step of pushing.

Another feature of the present invention is the provision in a method for engaging a tray to a high chair receptacle, of the structural integrity of at least one of the tray, high chair receptacle, left receiver, right receiver, left extension, right extension, left ramp, right ramp, left tab, and right tab being destroyed by carrying out one of the steps of e) lowering the left and right tabs downwardly upon the left and right ramps, f) raising the left and right tabs upwardly upon the left and right ramps, g) pushing the left and right tabs from a position in front of the left and right ramps onto the left and right ramps without carrying out the step of making, and h) pushing the left and right tabs from a position back of the left and right ramps onto the left and right ramps.

An advantage of the present invention is safety. One feature contributing to this advantage is the one way engagement. With a one way engagement, the chances of an incorrect and unsafe connection of the tray to the high chair are minimized. Another feature contributing to this advantage is the one way disengagement, where the tray cannot be lifted upwardly, or tilted frontwardly, rearwardly, to the right side, or to the left side until the tray is slid frontwardly. Another feature contributing to this advantage is that when the tray is slid frontwardly, the tray is kept level, thereby minimizing the chances of glasses, plates, utensils, and food sliding off the tray and onto the child or floor.

Another advantage of the present invention is that the foot rest is maintained at a predefined elevation without locks. One feature contributing to this advantage is the provision of first and second legs engaging the foot rest at an oblique angle such that the first and second legs taper away from each other at the locations where the first and second legs engage the foot rest. Thus, the foot rest can slide neither in the upward direction nor in the downward direction without destroying the structural integrity of the foot rest.

Another advantage of the present invention is that the foot rest is not removable until at least one of the legs engaging the foot rest is itself removed from a base of the receptacle.

Another advantage of the present invention is that the high chair apparatus may be breakable down into a small package. Features contributing to this advantage are that the first, second, third, and fourth legs are removable, that the high chair tray is removable, and that the foot rest is removable.

Another advantage of the present invention is that the high chair apparatus is easily and quickly set up by the end user. Features contributing to this advantage are that first and second legs are easily slideable into and through the foot rest prior to the first and second legs being engaged to a base of the receptacle, that upper portions of the legs have quick connects that engage a base of the high chair receptacle, and that the tray and receptacle have quick connects for engagement of the tray to the receptacle.

Another advantage of the present invention is that the high chair apparatus is inexpensive and includes a minimum number of parts.

BRIEF DESCRIPTION OF THE DRAWINGS

FIG. 21A is a perspective top view of the foot rest of the high chair apparatus of FIG. 1.

FIG. 21B is a top view of the foot rest of FIG. 21A.

FIG. 21C is a front view of the foot rest of FIG. 21A.

FIG. 21D is a side view of the foot rest of FIG. 21A.

FIG. 21E is a section view of the foot rest of FIG. 21A.

DESCRIPTION

Figure 1:
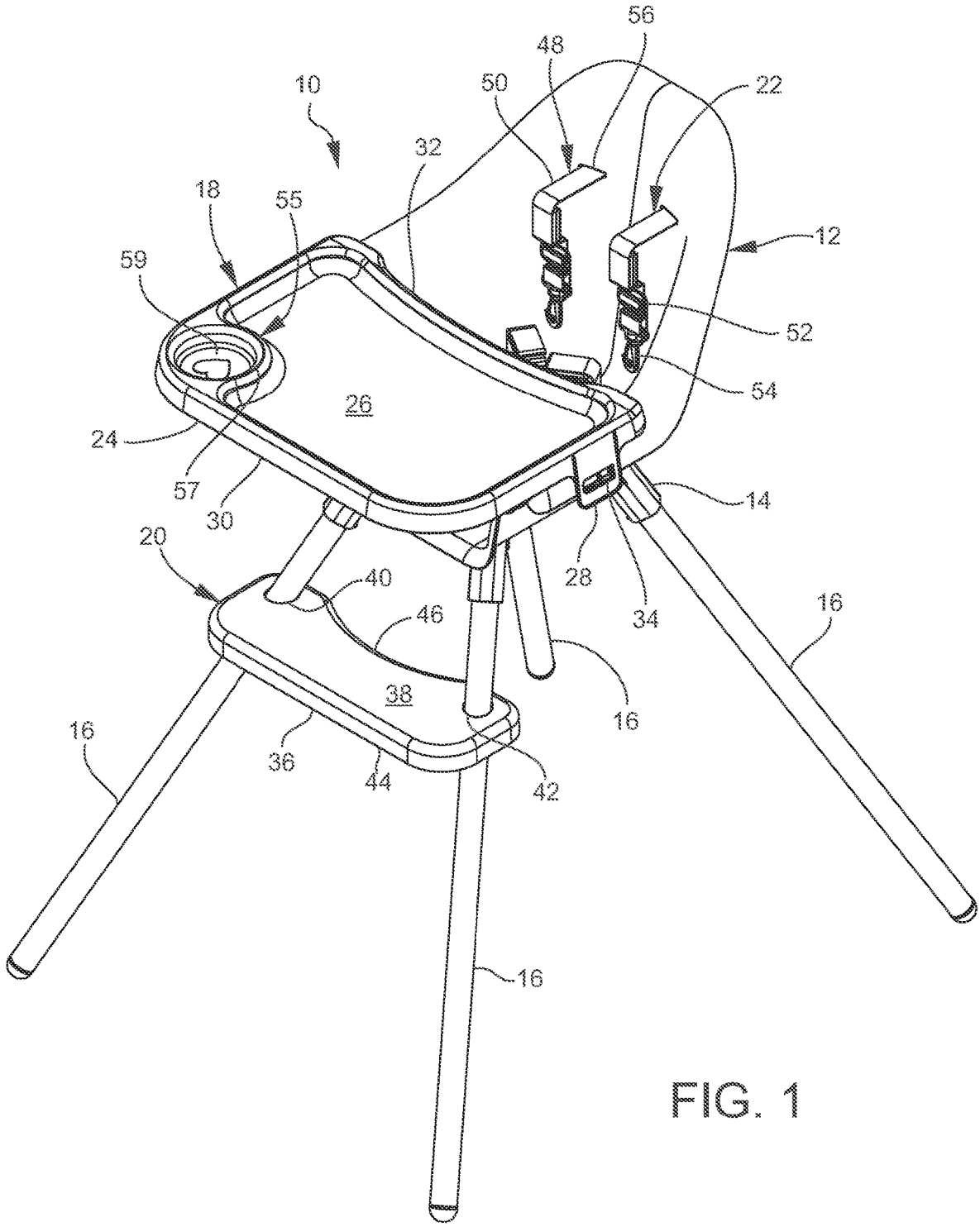
FIG. 1 is a perspective view of the present high chair apparatus.

FIG. 1 is a perspective view of the present high chair apparatus 10. As shown in FIG. 1, high chair apparatus 10 includes a receptacle 12 for a child, leg receivers 14 depending from the receptacle 12, a set of four legs 16 engaged in and depending from the leg receivers 14, a tray 18 engaged to the receptacle 12, a foot rest 20 engaged to front legs 16, and a harness 22 engaged to the receptacle 12.

As shown in FIG. 1, tray 18 includes an endless periphery 24, a flat eating surface 26 that defines a plane and that is disposed within the endless periphery 24, and a tab 28. Tab 28 is resiliently engaged to the tray 18. Tab 28 is resiliently bendable outwardly. The tab 28 extends downwardly and outwardly from the tray 18 when the tab 28 is unflexed. The tab 28 extends obliquely relative to the flat eating surface 26 when the tab 28 is unflexed. The tab 28 extends longitudinally in a direction from a rear 30 of the tray 18 to a front 32 of the tray 18. The rear 30 of the tray 18 includes an elongate straight portion. The front 32 of the tray 18 includes an elongate U-shaped portion to conform to the body of the child in the high chair apparatus 10. The tab 28 includes a slot 34. The slot 34 is a through slot. The slot 34 extends laterally through the tab 28.

As shown in FIG. 1, foot rest 20 includes an endless periphery 36. A flat foot rest surface 38 defines a plane and is disposed within the endless periphery 36. A right front leg 16 extends through the flat foot rest surface 38 at a back right corner portion of the foot rest 20. A left front leg 16 extends through the flat foot rest surface 28 at a back left corner portion of the foot rest 20. Right front leg 16 passes through opening 40 of the flat foot rest surface 38 and left front leg 16 passes through opening 42 of the flat foot rest surface 38. Each of openings 40, 42 is spaced from the periphery 20. It should be noted that right and left front legs 16 extend outwardly and away from each other such that the axes of the right and left front legs 16 taper away from each other. Tray eating surface 26 and foot rest surface 38 each define a plane and such planes are parallel to each other. The axes of right and left front legs 16 are disposed obliquely relative to the planes of the tray eating surface 26 and foot rest surface 38.

As shown in FIG. 1, the endless periphery 36 of the foot rest 20 includes a front straight portion 44 and a rear U-shaped portion 46 that extends inwardly.

As shown in FIG. 1, harness 22 includes two over the shoulder harness portions 48. Each of the harness portions 48 includes a strap 50 that extends through a buckle portion 52 and then engages a quick connect 54. Buckle portion 52 operates to lengthen or shorten its respective harness portion 48. Strap 50 extends through slot 56 formed in the receptacle 12.

As shown in FIG. 1, tray 18 includes cup or glass holder 55 having a lip or ridge 57 that is circular and communicates with the periphery 24. Periphery 24 and cup holder lip or ridge 58 have the same height. From the apex of ridge 57, ridge 57 tapers downwardly and outwardly to the eating surface 26. The floor 59 of the cup holder 55 defines a plane the is coplanar with the plane of eating surface 26.

Figure 2:
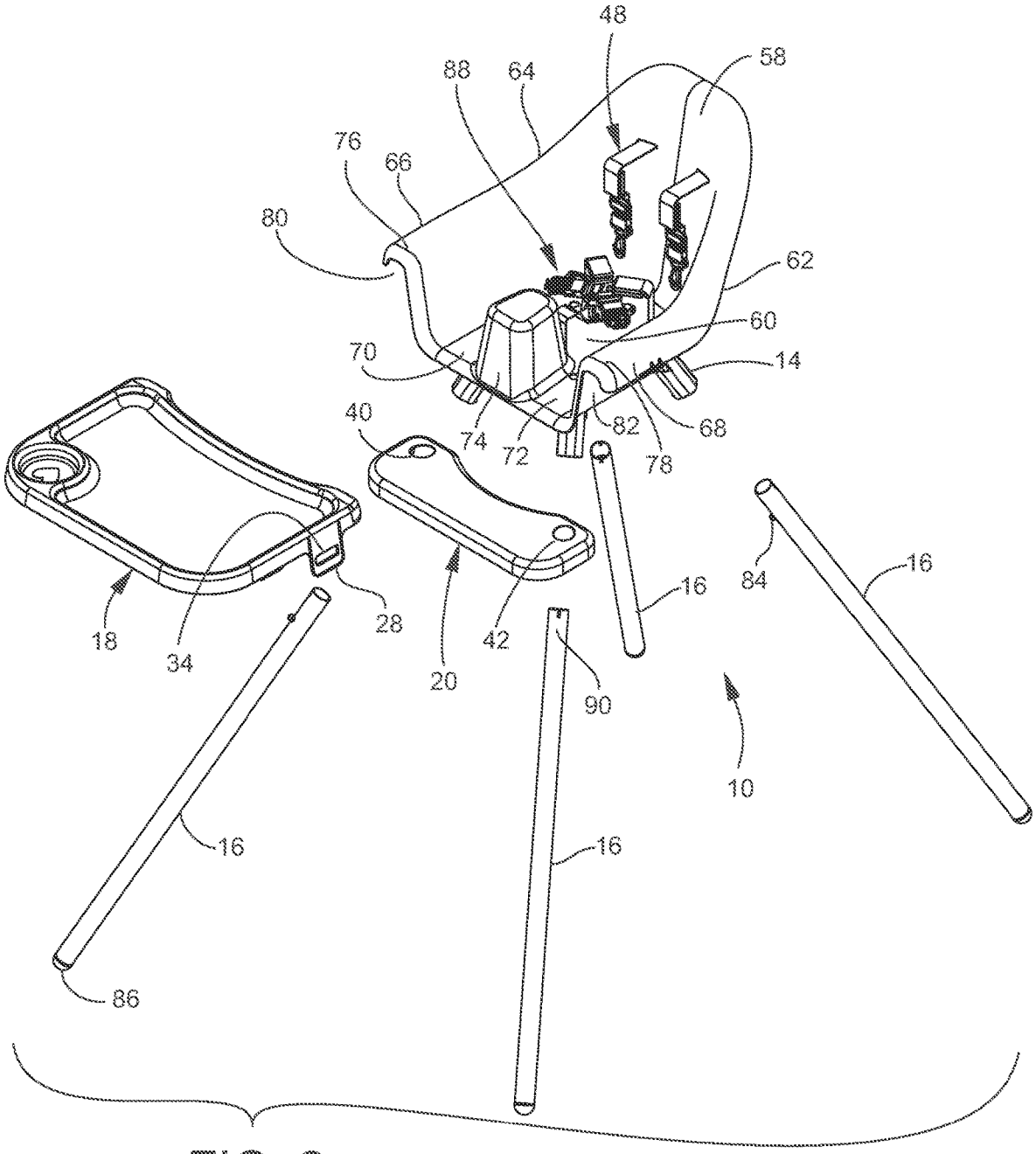
FIG. 2 is an exploded perspective view of the high chair apparatus of FIG. 1.

FIG. 2 is an exploded perspective view of the high chair apparatus 10. FIG. 2 shows that the child receptacle 12 includes a back portion 58, a seat portion 60, a left side portion 62, a right side portion 64, a right arm rest 66, a left arm rest 68, a right leg portion 70, a left leg portion 72, and a crotch restraint 74.

As shown in FIG. 2, each of the arm rests 66, 68 includes a respective receiver 76, 78, and each of the receivers 76, 78 includes an open front end 80, 82.

As shown in FIG. 2, each of the legs 16 is tubular. Each of the legs 16 includes a spring based button 84 that locks into a hole or detent in the leg receiver 14. Each of the bottom portions of the legs 16 includes inserted therein a plug 86 that is formed of rubber or an elastomer or other friction reducing, floor grabbing material to minimize sliding of the high chair apparatus 10, to grip a floor, and to minimize scratching of a floor surface.

FIG. 2 further shows a lap portion 88 for the harness 48.

FIG. 2 further shows that the upper ends of the legs 16 include diametrically opposite slots 90 that engage tabs in receivers 14 to orientate buttons 84 to engage button receptacles in the leg receivers 14.

Figure 3:
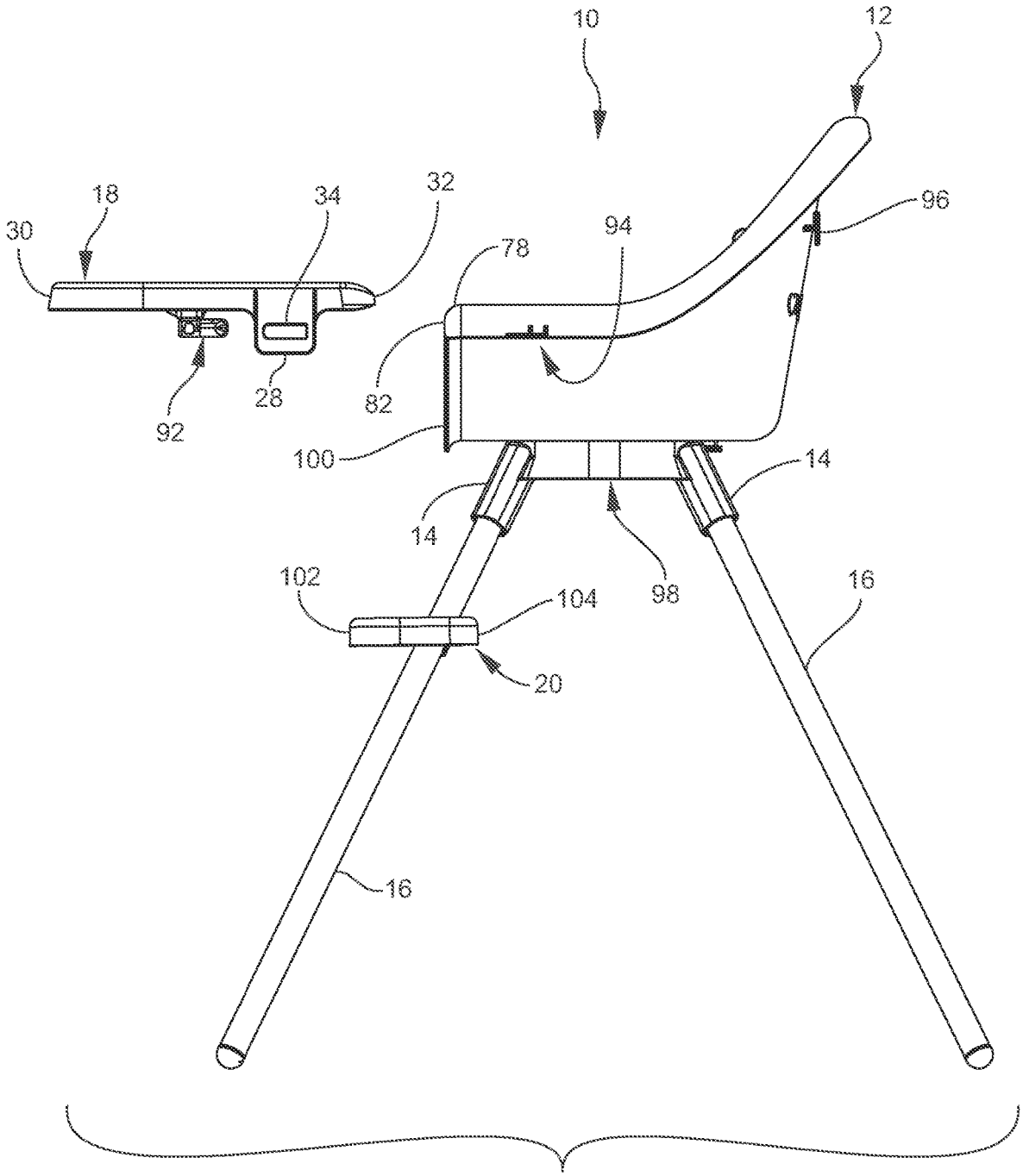
FIG. 3 is a side view of the high chair apparatus of FIG. 1 showing the extension of the tray co-axial with the receiver of the receptacle of the high chair apparatus, prior to engagement of the tray to the receptacle of the high chair apparatus.

FIG. 3 is a side view of the high chair apparatus 10 and shows an extension 92 of the tray 18 co-axial with the open front end 82 of the receiver 78 of the receptacle 12 of the high chair apparatus 10, prior to engagement of the tray 18 to the receptacle 12 of the high chair apparatus 10. FIG. 3 further shows a ramp 94 on the receptacle 12 that engages the slot 34 of the tab 28 of the tray 18.

Extension 92 is engaged to the tray 18. Extension 92 extends in a direction from the rear 30 of the tray 18 to the front 32 of the tray 18. The extension 92 includes a distal end and a proximal end. The distal end of the extension 92 is engaged to the tray 18. The proximal end of the extension 92 is spaced from the underside of the tray 18. The distal end of the extension 92 is closer to the rear 30 of the tray 18 than is the proximal end of the extension 92. The extension 92 slideably and removably engages the open front end 82 of the receiver 78 of the receptacle 12.

The receiver 78 is integral and one-piece with the receptacle 12.

Ramp 94 is engaged to the receptacle 12 and is integral therewith and one-piece therewith.

FIG. 3 shows that slot 34 is horizontally aligned with the ramp 94 and that the extension 92 is horizontally aligned with the open front end 82 of the receiver 78. FIG. 3 further shows that tab 28 and slot 34 is disposed forwardly of the extension 92 and that the extension 92 is spaced from the tab 28. FIG. 3 shows that the open front end 82 of the receiver 78 is disposed forwardly of and spaced from the ramp 94.

FIG. 3 further shows that an integral end portion 96 of strap 50 takes the shape of a T such that integral end portion 96 can both 1) work as a stop to prevent the strap 50 from being pulled forwardly through and out of slot 56 and 2) be folded flat against the body of the strap 50 to permit the integral end portion 96 to be pulled forwardly through and out of slot 56.

FIG. 3 further shows that the left front leg 16 and the left rear leg 16 taper outwardly and away from each other. The same is true for the right front leg 16 and the right rear leg 16.

FIG. 3 further shows that the leg receivers 14 are engaged to a base 98 that in turn is engaged to receptacle 12. FIG. 3 shows that the left front and left rear leg receivers 14, like the left front and left rear legs 16, taper outwardly and away from each other.

FIG. 3 further shows that a front end 100 of the receptacle 12 is disposed vertically over the foot rest 20. Foot rest 20 includes a front end 102 and a rear end 104. The front end 100 of the receptacle 12 is disposed vertically between the front and rear ends 102, 104 of the foot rest 20.

FIG. 3 further shows that the extension 92 is spaced from the periphery 24 that is disposed above the extension 92. FIG. 3 shows that the horizontal axis of the extension 92 is disposed above the horizontal axis of the slot 34.

Figure 4:
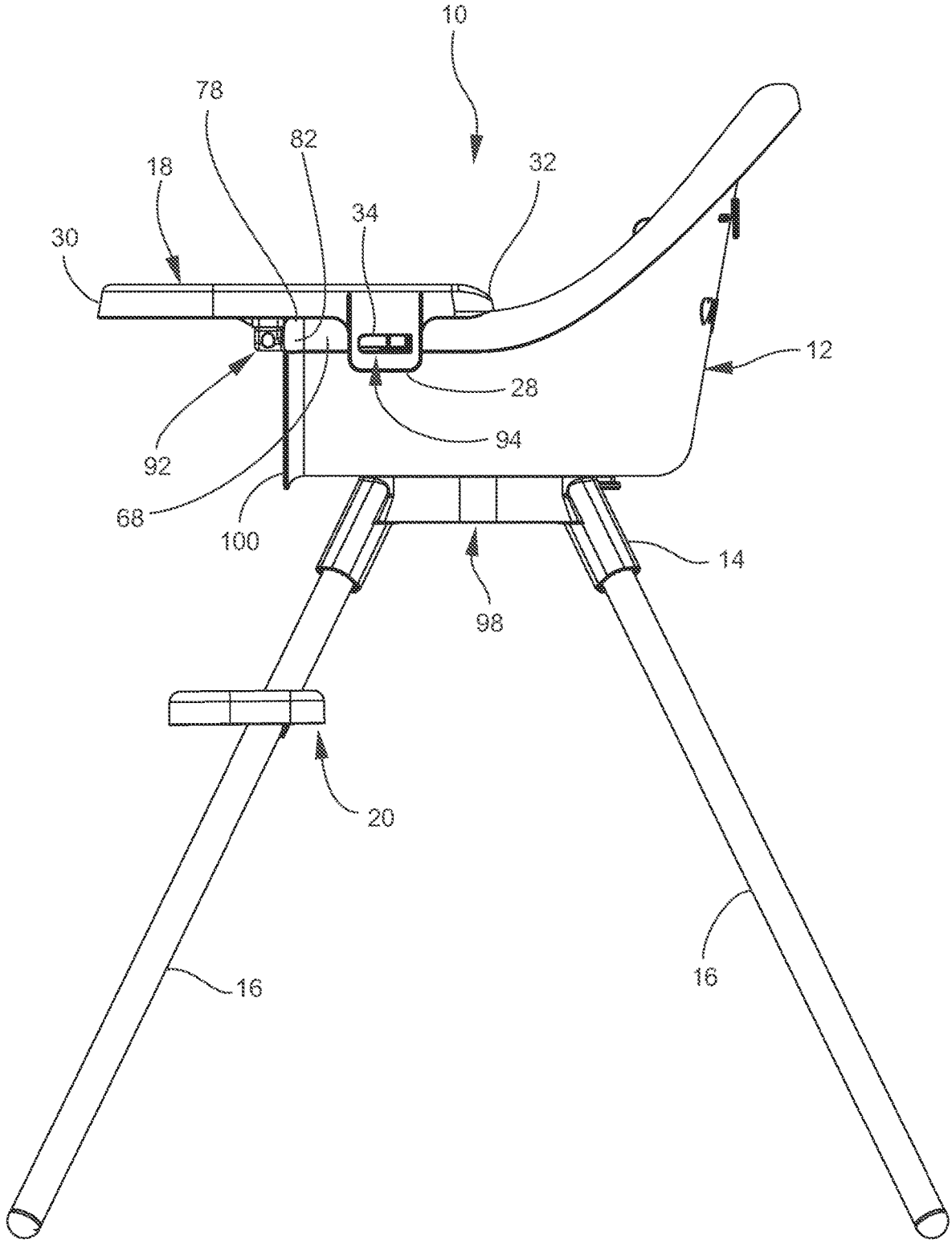
FIG. 4 is a side view of the high chair apparatus of FIG. 3 showing that the extension of the tray engaged with the receiver of the receptacle of the high chair apparatus.

FIG. 4 shows the tray 18 engaged with the receptacle 12. Namely, the extension 92 of the tray 18 is engaged with the open front end 82 of the receiver 78 of the receptacle 12 and the ramp 94 is engaged in the slot 34 of the tab 28.

FIG. 4 shows that the tray 18 defines a plane and that the foot rest 20 defines a plane and that, when the tray 18 is engaged to the receptacle 12, such planes extend parallel to each other.

FIG. 4 shows that the tray 18 is on the arm rests 66, 68 of the receptacle 12 when the ramp 94 is engaged in the slot 34 and when the extension 92 is engaged in the open front end 82 of the receiver 78.

Figure 5:
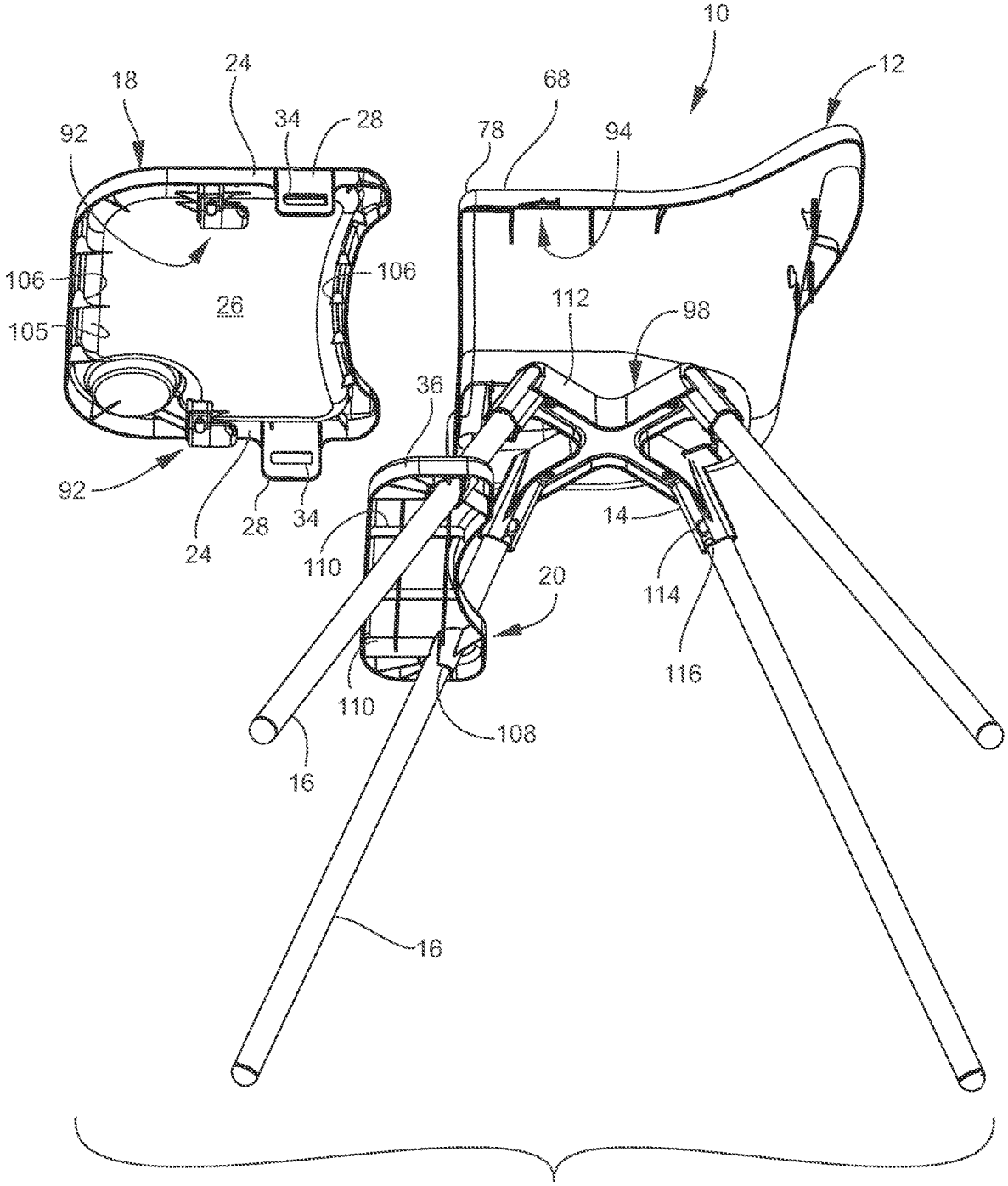
FIG. 5 is an exploded perspective view of the high chair apparatus of FIG. 1 where the view is from underneath the high chair apparatus and where the tray is disengaged from the receptacle of the high chair apparatus.

FIG. 5 is an exploded perspective view of the high chair apparatus 10 where the view is from underneath the high chair apparatus 10 and where the tray 18 is disengaged from the receptacle 10.

FIG. 5 shows that the tray 18 includes first and second tabs 28, with each of the tabs 28 including the slot 34. Each of the tabs 28 is continuous with and forms part of the endless periphery 24 of the tray 18. Tabs 28 are opposite of each other. One of the tabs 28 is on one side of the tray 18. The other of the tabs 28 is on the other side of the tray 18. Each of the front and rear edges of the tabs 28 are closer to the front of the tray 18 than the back of the tray 18.

FIG. 5 shows that the tray 18 includes first and second extensions 92. FIG. 5 shows that each of the extensions 92 depends from the tray 18 at a location disposed inwardly of the endless periphery 24. FIG. 5 shows that the frontmost portion of the extension 92 is disposed rearwardly of the rearmost portion of the tab 28. FIG. 5 shows that extension 92 is L-shaped.

FIG. 5 shows that the endless periphery 24 is an upside down channel 105 that includes ribs 106 extending upwardly into the channel 105, to the outer wall of the channel 105, and to the eating surface 26 of the tray 18. Each of the ribs 106 extends perpendicularly from the portion of the outer peripheral wall to which it is integrally engaged.

FIG. 5 shows that the foot rest 20 include integral cylindrical portions 108 that engage the front legs 16. FIG. 5 shows that the foot rest 20 includes longitudinally extending integral ribs 110, laterally extending integral ribs 110, obliquely extending integral ribs 110, integral ribs 110 extending between front and rear portions of the foot rest periphery 36, longitudinal integral ribs 110 extending from the integral cylindrical portions 108 to the integral periphery 36, and oblique integral ribs 110 extending from the integral cylindrical portions 108 to the periphery 36. At their upper portions, the integral ribs 110 integrally engage the foot rest surface 38.

FIG. 5 shows the base 98 for the receptacle 12. Base 98 includes four upside down channels 112 that together form an "X" shape. The four channels 112 lead into each other. At their outer ends, the four channels 112 integrally engage the leg receivers 14. Each of the leg receivers 14 includes a button opening 114 and a button depressor 116 that includes a tapering face. Leg button 84 slides into the button depressor 116, then hits the tapering face of the depressor 116 and is thereby depressed, then slides in a depressed state further into the leg receiver 14, and then automatically pops out into the button opening 114, thereby locking the leg 16 to the base 98 and to the receptacle 12. Base 98 may be engaged, such as by being pinned thereto, to the bottom of the receptacle 12.

Figure 6:
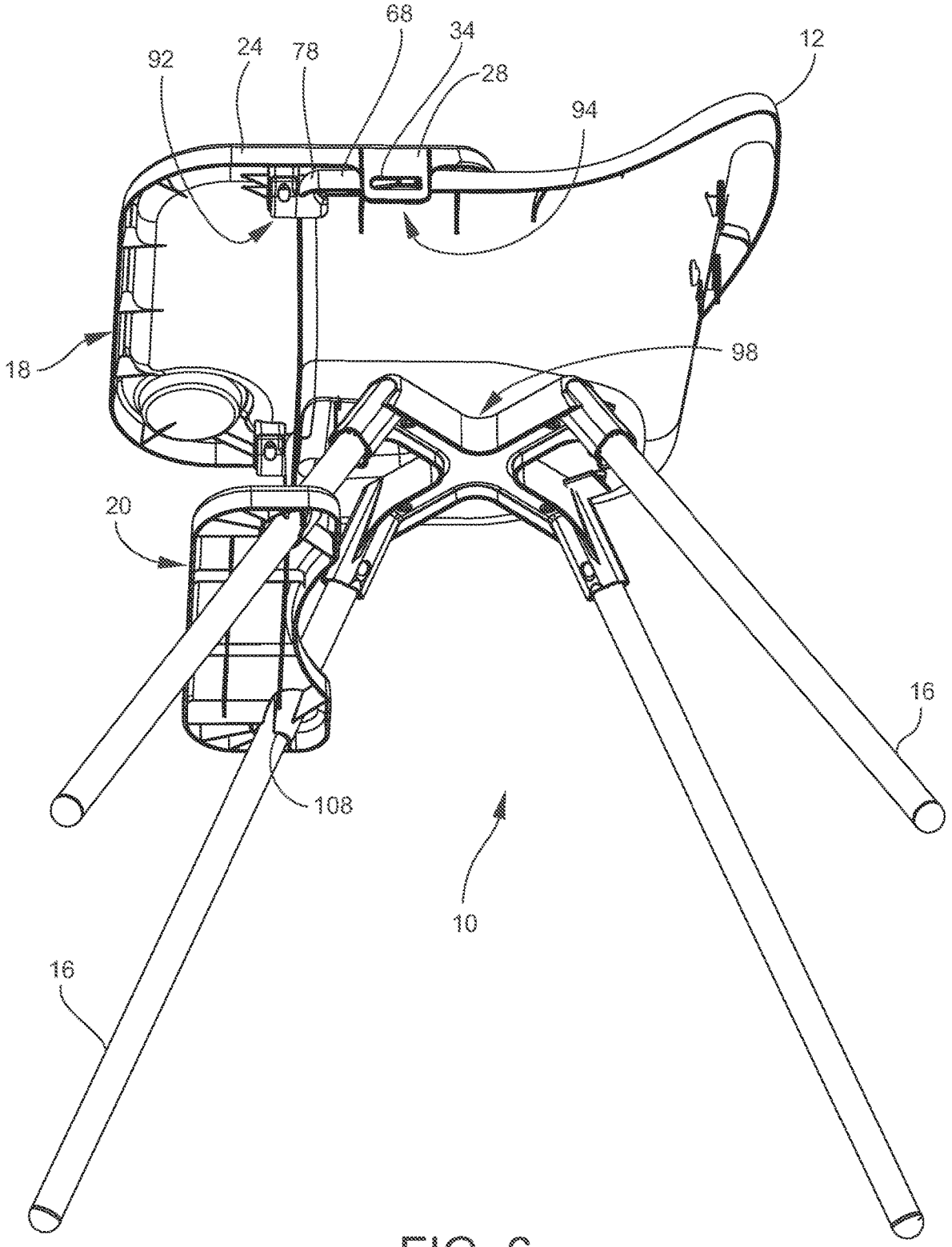
FIG. 6 is an exploded assembled view of the high chair apparatus of FIG. 5 where the view is from underneath the high chair apparatus and where the tray is engaged to the receptacle of the high chair apparatus.

FIG. 6 is an exploded assembled view of the high chair apparatus 10 of FIG. 5 where the view is from underneath the high chair apparatus 10 and where the tray 18 is engaged to the receptacle 12 of the high chair apparatus 10. FIG. 6 shows the ramp 94 engaged in the slot 34 and, at the same time, the extension 92 is engaged in the open front end 82 of the receiver 78. To arrive at such an engaged position, the front corner portions of the periphery 24 are placed on the arm rests 66, 68 with the tray 18 in a horizontal position, then with the tray 18 continuing to be held in the horizontal position the tray 18 is slid forward such that the extensions 92 enter the open front ends 80, 82 of the receivers 76, 78 and such that the front edges of the tabs 28 encounter the ramps 94, and then with the tray 18 continuing to be held in the horizontal position the tray 18 is slid further forwardly until the upright portion of the L-shaped extension 92 hits the receivers 76, 78 (or front ends of the arm rests 66, 68) and until the tab 28 is resiliently bent outwardly by the ramps 94 and then snaps inwardly when the ramps 94 encounter the slots 34, thereby locking the ramps 94 in the slots 34 and preventing any further movement of the tray 18. In such an engaged position, the tray 18 may not be lifted vertically off the receptacle 12, or pushed down for disengagement, or pushed rearwardly in the direction toward the back portion 58 of the receptacle 12 for disengagement. In such an engaged position, the only direction for disengagement is a horizontal pulling of the tray 18 in the direction toward the rear 30 of the tray 18. Such a disengagement may take place only after the tabs 28 are resiliently drawn outwardly so as to disengage the slots 34 from the ramps 94, whereupon the tray 18 may not be pushed forwardly or lifted upwardly or pushed downwardly but only withdrawn in a direction toward the rear 30 of the tray 18. The extensions 92 prevent an upward lifting of the tray 18 until the extensions 92 have been completely slid out of the open front ends 80, 82.

Figure 7:
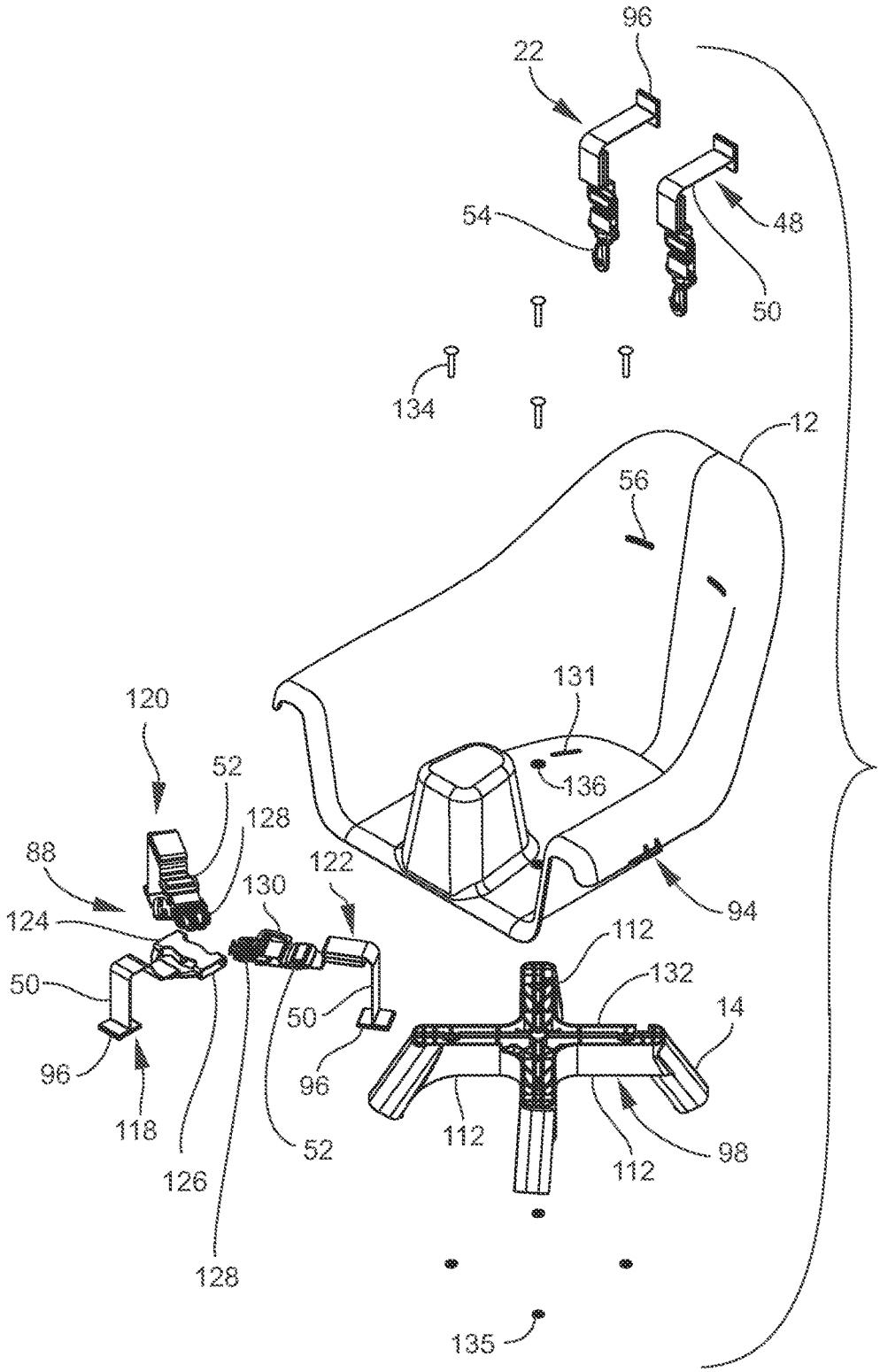
FIG. 7 is an exploded perspective view of the receptacle and base of the high chair apparatus of FIG. 1.

FIG. 7 is an exploded perspective view of the receptacle and base of the high chair apparatus of FIG. 1. FIG. 7 shows the lap portion 88 of the harness 22. Lap portion 88 includes three strap portions 118, 120, 122. Each of the strap portions 118, 120, 122 includes the T-shaped portion 96 that can both 1) work as a stop to prevent its respective strap 50 from being pulled forwardly through and out of a receptacle slot and 2) be folded flat against the body of the strap 50 to permit the integral end portion 96 to be pulled forwardly through and out of receptacle slot. Each of strap portions 120, 122 includes buckle portion 52 for lengthening and shortening strap 50. Strap portion 118 does not include such buckle portion 52. Strap portion 118 includes a female buckle piece 124 having first and second opposing female receptors 126. Each of strap portions 120, 122 includes a male buckle piece 128 for engagement in one of the female receptors 126 of buckle piece 124. Each of the male buckle pieces 128 includes a loop 130 that is engaged by one of the quick connects 54 of the over the shoulder harness portions 48. Strap 50 of strap portion 120 engages slot 131 in seat portion 60 of receptacle 12.

FIG. 7 shows an open top portion 132 of the base 98 and shows that the channels 112 are closed only when the base 98 is engaged to the bottom of the receptacle 12. FIG. 7 shows that the channels 112 have a number of ribs for strength. FIG. 7 shows that pins 134 are inserted through pin openings 136 in the seat portion 60 of the receptacle 12 to engage the base 98. Pins 134 engage nuts or pin connectors 135.

Figure 8:
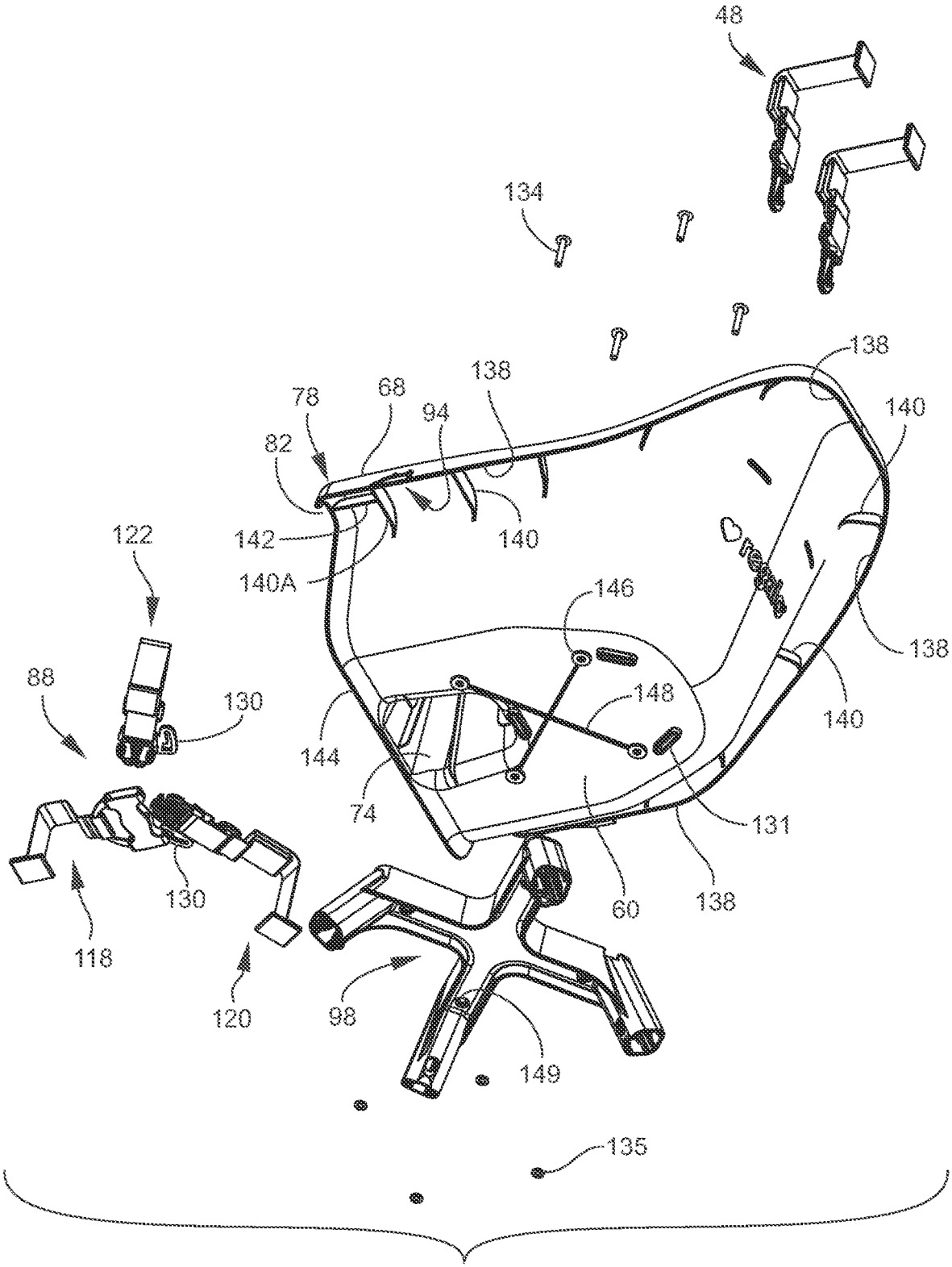
FIG. 8 is an exploded perspective view of the receptacle and base of the high chair apparatus of FIG. 1, where the view is taken from underneath the high chair base and high chair receptacle.

FIG. 8 is an exploded perspective view of the receptacle 12 and base 98 of the high chair apparatus 10, where the view is taken from underneath the high chair base 98 and high chair receptacle 12. FIG. 8 shows that the arm rest 68 is a portion of a folded over U-shaped receptacle periphery portion 138 that begins adjacent to open front end 82, continues to form arm rest 68, continues up the receptacle 12 to be adjacent to the back portion 58, continues about the back portion 58, continues on the other side of the receptacle 12 to form arm rest 66, and terminates at the other open front end 80. Periphery portion 138 has another U-shaped aspect to it. Such U-shaped aspect is the folded over aspect. Inside face portions of the periphery portion 138 confront opposite portions of the periphery portion 138 such that a channel is formed. Within this channel are ribs 140 set within the channel.

FIG. 8 shows the structure for receiver 78, and receiver 76 has the same structure at front open end 80. Receiver 78 includes open front end 82, one of the ribs 140 designated 140A, a longitudinal rib 142 engaged to and extending forwardly of such rib 140A, and a section of periphery portion 138. When extension 92 is in the receiver 78, extension 92 abuts the bottom edge of longitudinal rib 142. The rib 140A that is engaged to longitudinal rib 142 serves as a stop for the proximal end of extension 92. The open front end 82 may also serve as a stop for the extension 92 when the vertical portion of the L-shaped extension 92 abuts the open front end 82.

Figure 9A:
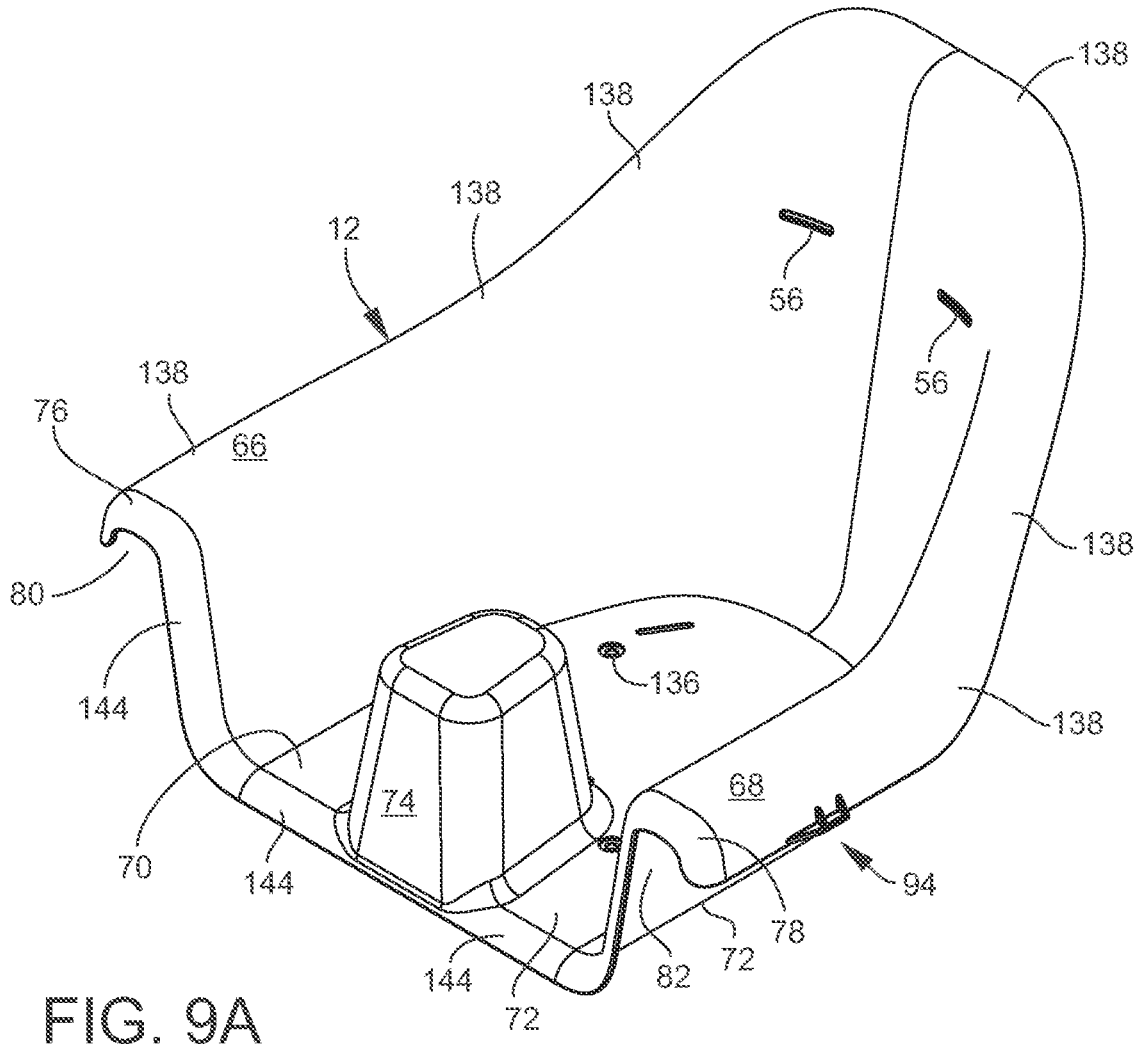
FIG. 9A is a perspective view of the receptacle of the high chair apparatus of FIG. 1.
Figure 10:
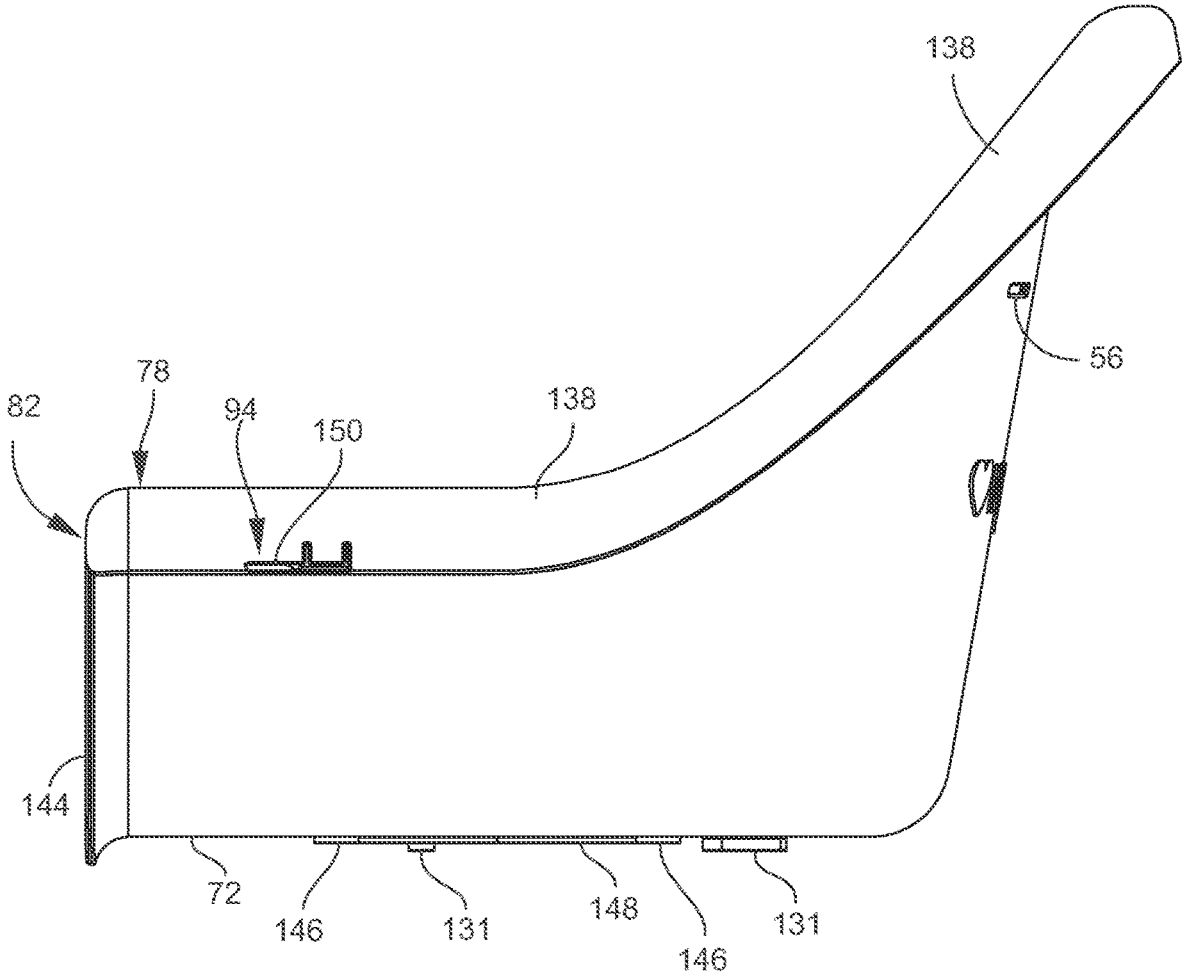
FIG. 10 is a side view of the receptacle of the high chair apparatus of FIG. 1.

FIG. 8 shows another periphery portion of the receptacle 12. This other periphery portion is front periphery portion 144. This periphery portion 144 is formed in an L-shape or a curved L-shape, as shown in FIGS. 9A and 10. This periphery portion 144 includes open front ends 80, 82. This periphery portion 144 extends from the front of the left arm rest 68 to the front of the right arm rest 66. This periphery portion 144 forms the left open front end 82 and the right open front end 80. Front periphery portion 144 is integrally engaged to the U-shaped periphery portion 138.

FIG. 8 shows that the underside of the seat portion 60 of the receptacle 12 includes four metal bosses 146 about four holes that receive the four pins 134. The four metal bosses 146 are one-piece with a metal "X" structure 148 engaged, such as by gluing, to the underside of the seat portion 60 of the receptacle 12.

FIG. 8 further shows the three slots 131 for the straps 50 of the lap portion 88 of the harness 22. On such slot 131 is adjacent to the rear end of the crotch restraint 74.

FIG. 8 shows that the base 98 includes pin openings 149 for pin connector 134. Pin connectors 134 are secured by nuts or connectors 135 to engaged the base 98 to the bottom of the receptacle 12.

Figure 9B:
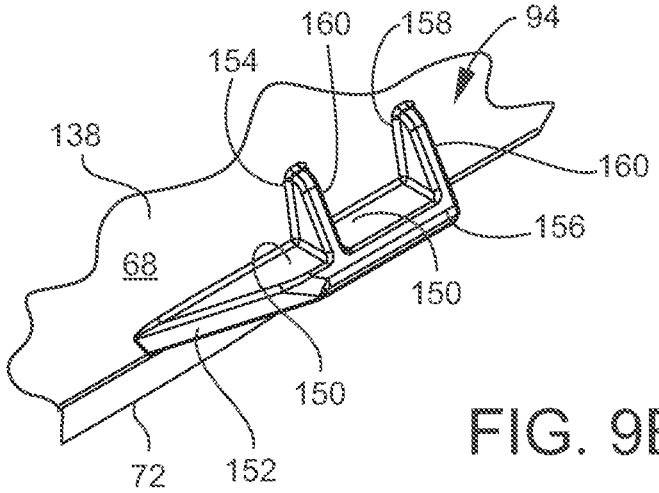
FIG. 9B is a perspective view of the left side ramp of the receptacle of FIG. 9A.

FIG. 9A is a perspective view of the receptacle 12 of the high chair apparatus 10 and shows the environment of the left side ramp 94. FIG. 9B is a perspective view of the left side ramp 94 of the receptacle 10. Ramp 94 is engaged to the peripheral portion 138 of the receptacle 12, and is engaged on the left arm rest 68, which is a portion of the peripheral portion 138. Ramp 94 is one-piece and integral with the receptacle 12. Ramp 94 extends outwardly from the receptacle 12. Ramp 94 includes a floor 150. Floor 150 includes a ramped or angled or oblique first straight edge 152 that extends from the body of the receptacle 12 to a first brace 154. Floor 150 includes a second straight edge 156 that extends from the rear end of the oblique edge 152 to a second brace 158 such that second straight edge 156 extends from first brace 154 to second brace 158. Second straight edge 156 runs parallel to the body of the receptacle 12. Floor 150 extends at a right angle from the body of the receptacle 12. First and second braces 154, 158 extend at a right angle relative to the floor 150. Each of the first and second braces 154, 158 includes an oblique edge 160 that extends from the body of the receptacle 12 to the second straight edge 156. When the tray 18 is slid onto the receptacle the front vertical edge of the tab 28 engages the ramped edge 152 and thereby draws the tab 28 outwardly until the front vertical edge of the slot 34 reaches the rear face of the second brace 158 and the rear end of the second straight edge 156, whereupon the tab 28 snaps back to its original unbiased position, thereby receiving the whole of the ramp 92 in the slot 34 and locking the ramp 92 therein. To unlock the tab 28 from the ramp 94, the user with his or her fingertips engages the bottom edge or portion of the tabs 28, draws the tabs 28 upwardly and outwardly, and then slides the tray 18 rearwardly, thereby pulling the extensions 92 out of the receivers 96, 98.

FIG. 9A shows that pin opening 136 is inset such that the top face of the head of the pin connector 134 lies flush with, or underneath of, the upper face of the seat portion 60 of the receptacle 12.

FIG. 9A shows that the left side portion of the receptacle 12 includes a left arm rest 66, that the right side portion of the receptacle 12 includes a right arm rest 68, that the receiver 76 of a left engagement mechanism is adjacent to the left arm rest 66, and that the receiver 78 of a right engagement mechanism is adjacent to the right arm rest 66. The left receiver 76 includes the left open front end 80. The right receiver 78 includes the right open front end 82.

FIG. 9A shows that the ramp 94 includes a distal portion and a proximal portion and further shows that the ramp outer edge 152 tapers outwardly and rearwardly from the proximal portion.

FIG. 9B shows that the ramp 94 includes the floor 150, the first laterally extending rib or brace 154, and the second laterally extending rib or brace 158. The floor 150 includes the ramped outer edge 152. The first laterally extending rib or brace 154 extends from the floor 150 of the ramp 94 to the receptacle 12. The second laterally extending rib extends from the floor 150 of the ramp 94 to the receptacle 12. Each of the first and second laterally extending ribs or braces 154, 158 are receivable in the slot 34.

FIG. 10 is a side view of the receptacle 12. FIG. 10 shows that the floor 150 of the ramp 94 extends along a bottommost portion of periphery 138. FIG. 10 shows that the top portions of the ramp 94 are spaced from a top adjacent portion of the periphery 138. FIG. 10 shows that the frontmost portion of the ramp 94 is spaced from the front periphery portion 144 of the receptacle 12.

FIG. 10 shows that the front periphery portion 144 is formed in shallow C-shape, or an L-shape or a curved L-shape.

Figure 11:
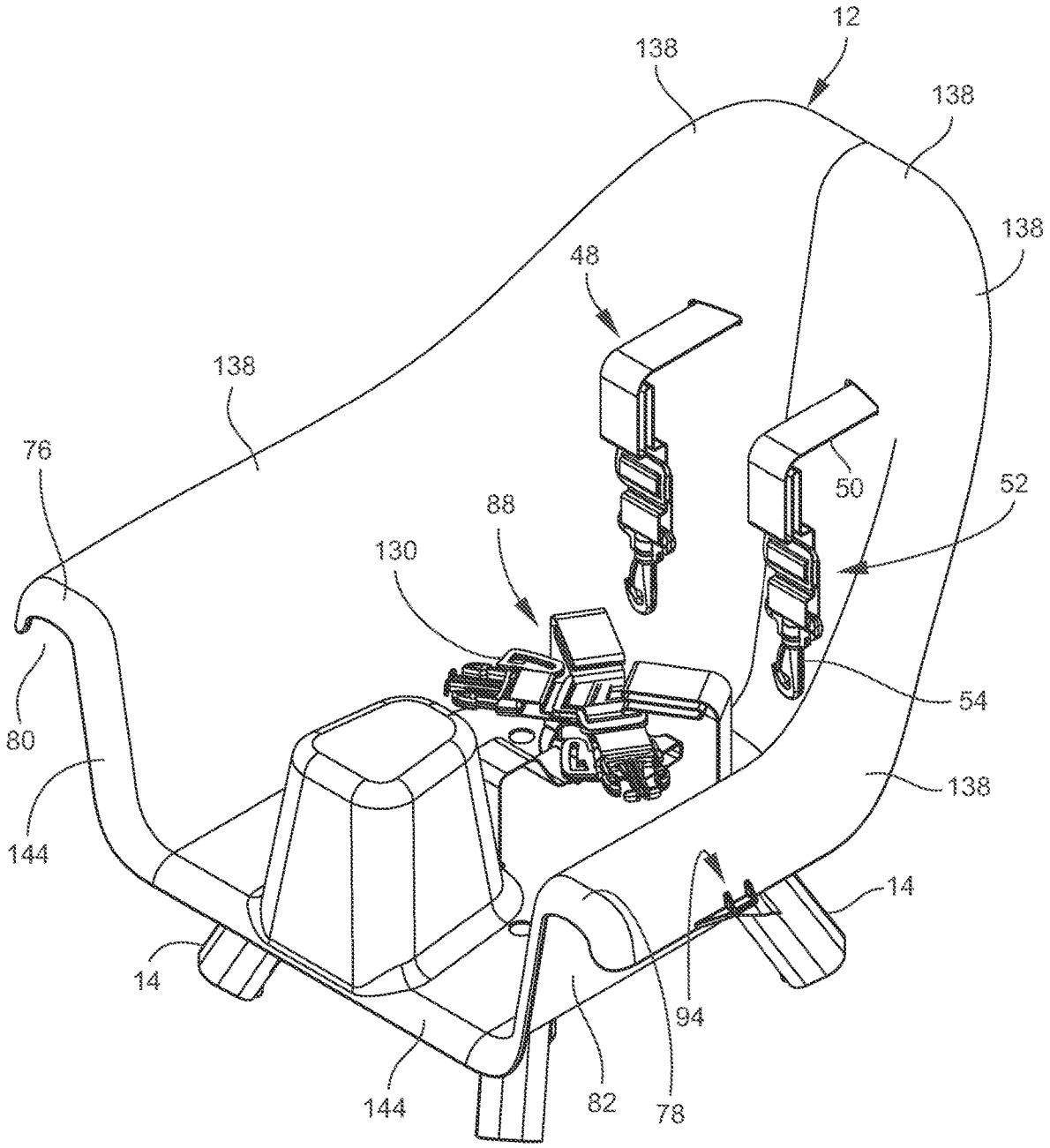
FIG. 11 is a perspective view of the receptacle of the high chair apparatus of FIG. 1 where the receptacle includes a five point harness for engaging the torso of a child.

FIG. 11 is a perspective view of the receptacle 12 of the high chair apparatus 10, and shows the five point harness 22 for engaging the torso of a child. FIG. 11 shows that the quick connect 54 is a swivel quick connect that rotates for 360 degrees. FIG. 11 shows that the quick connect 54 is a snap quick connect.

Figure 12A:
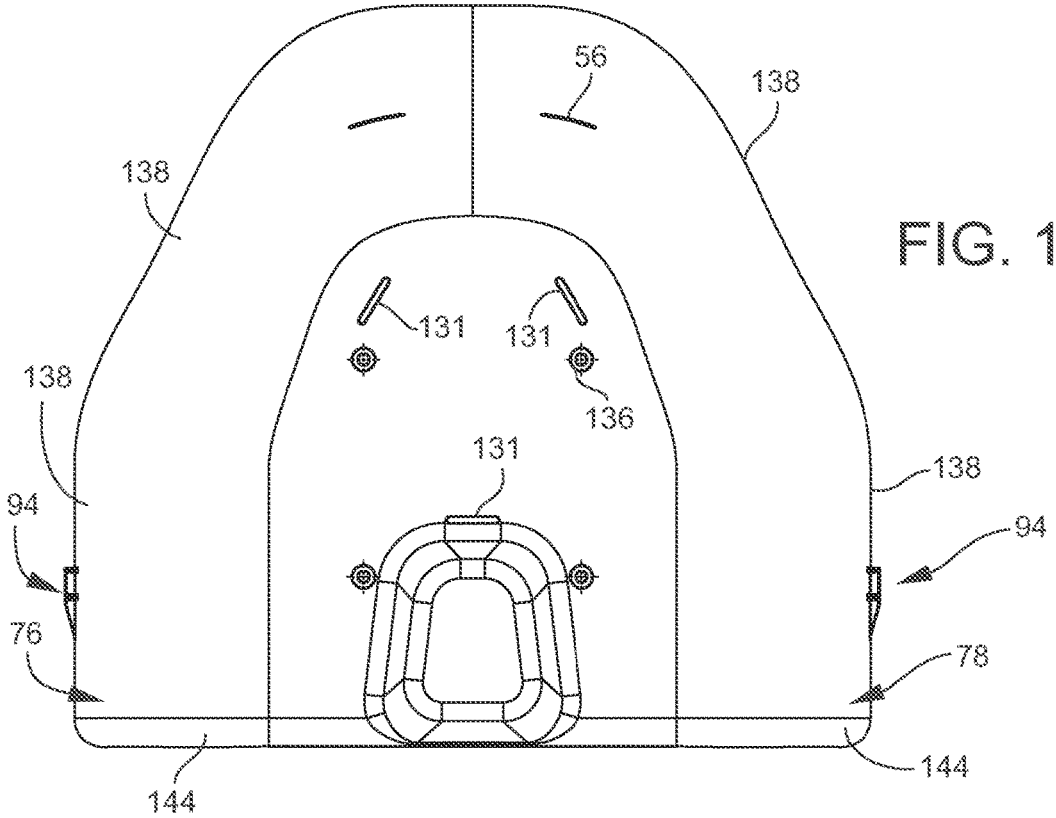
FIG. 12A is a top view of the receptacle of the high chair apparatus of FIG. 1.
Figure 12B:
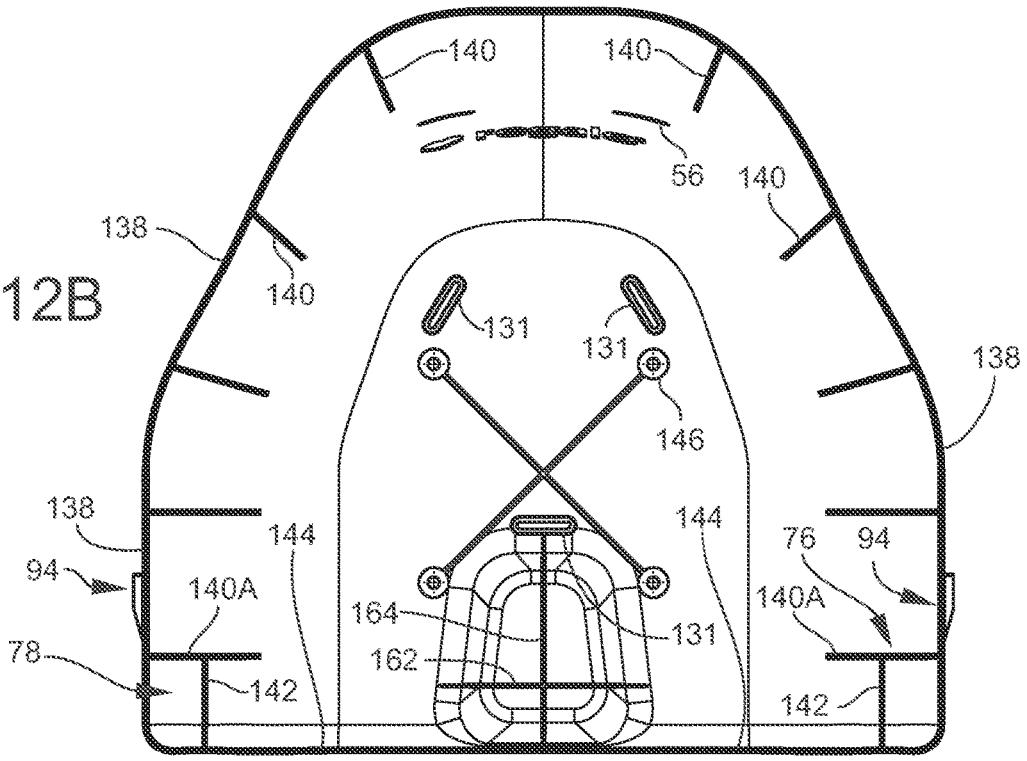
FIG. 12B is a bottom view of the receptacle of the high chair apparatus of FIG. 1.

FIG. 12A is a top view of the receptacle 12. FIG. 12B is a bottom view of the receptacle 12. Each of FIGS. 12A and 12B shows that receptacle 12 includes first and second ramps 94, one on one side of the receptacle 12 and one on the other side of the receptacle 12. FIG. 12A shows the four pin holes 136 and FIG. 12B shows their four respective metal bosses 146. FIGS. 12A and 12B show the slots 131 for the straps 50 of the lap portion 88 of the harness 22. FIG. 12B shows the longitudinal rib 142 and its associated rib 140A of the extension receivers 76, 78. FIG. 12B shows that crotch restraint 74 includes an inner lateral rib 162 and an inner longitudinal rib 164. Each of FIGS. 12A and 12B show that the crotch restraint 74 includes front and rear edges and that, if straight lines placed on these edges are extended, that both ramps 94 fall within the respective front and rear lines. FIGS. 12A and 12B show that the ramps 94 engage straight outer portions of the U-shaped periphery portion 138. Each such straight outer portions extends at right angle relative to the front periphery portion 144.

Figure 13A:
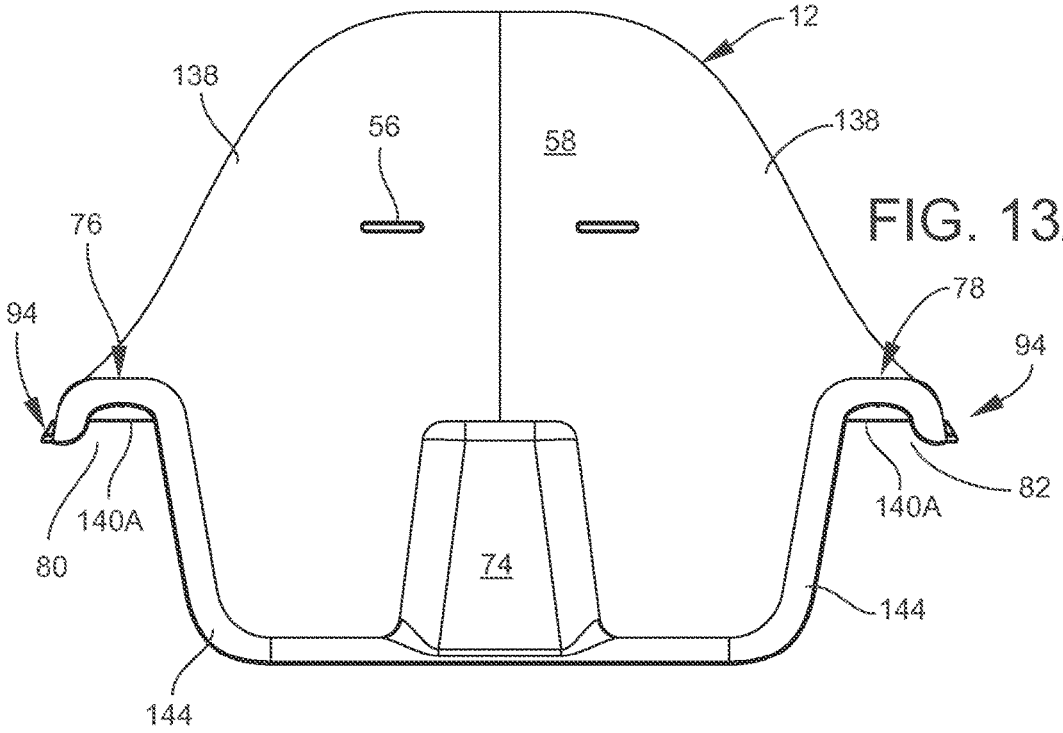
FIG. 13A is a front view of the receptacle of the high chair apparatus of FIG. 1.
Figure 13B:
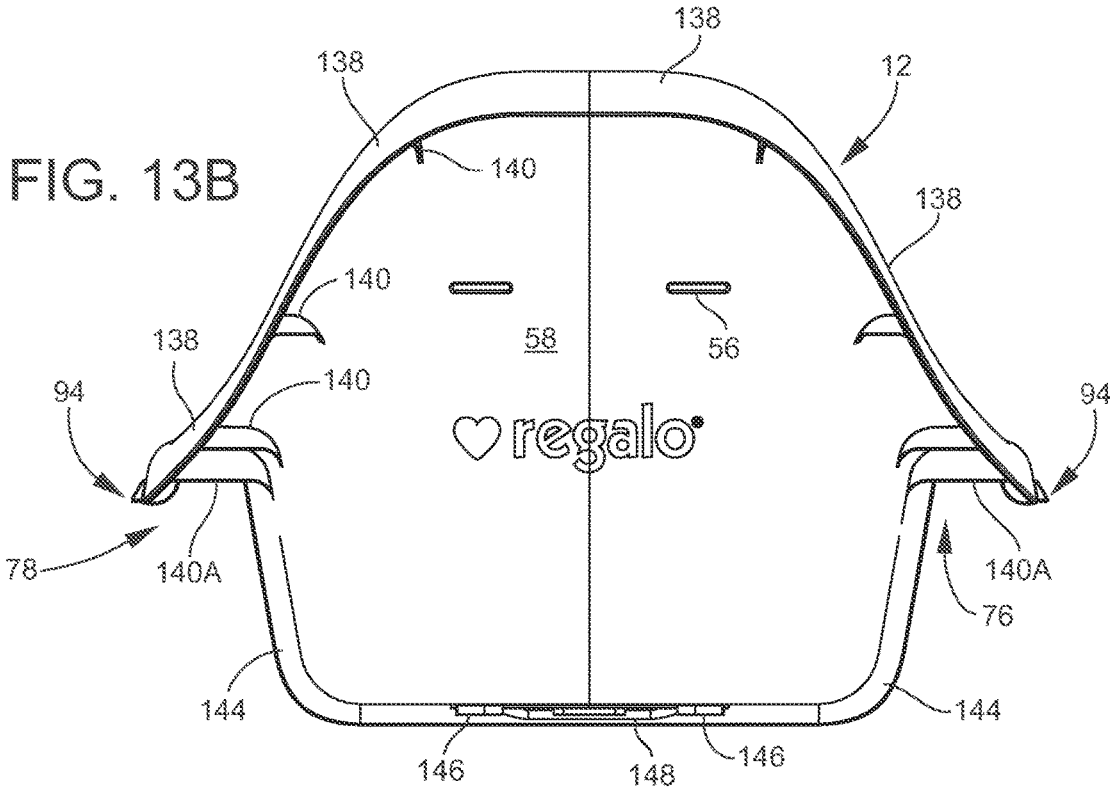
FIG. 13B is a rear view of the receptacle of the high chair apparatus of FIG. 1.

FIG. 13A is a front view of the receptacle 12. FIG. 13B is a rear view of the receptacle 12. FIGS. 13A and 13B show the rib 140A that works as a stop against further sliding of the extension 92. Rib 140A is disposed rearwardly of its respective open front end 80, 82. Rib 140A stops the front end of the extension 92. FIG. 13A shows that each of the open front ends 80, 82 take a U-shape. FIGS. 13A and 13B show that the lower edge of rib 140A is at a lower elevation than the uppermost portion of the open front ends 80, 82.

Figure 14:
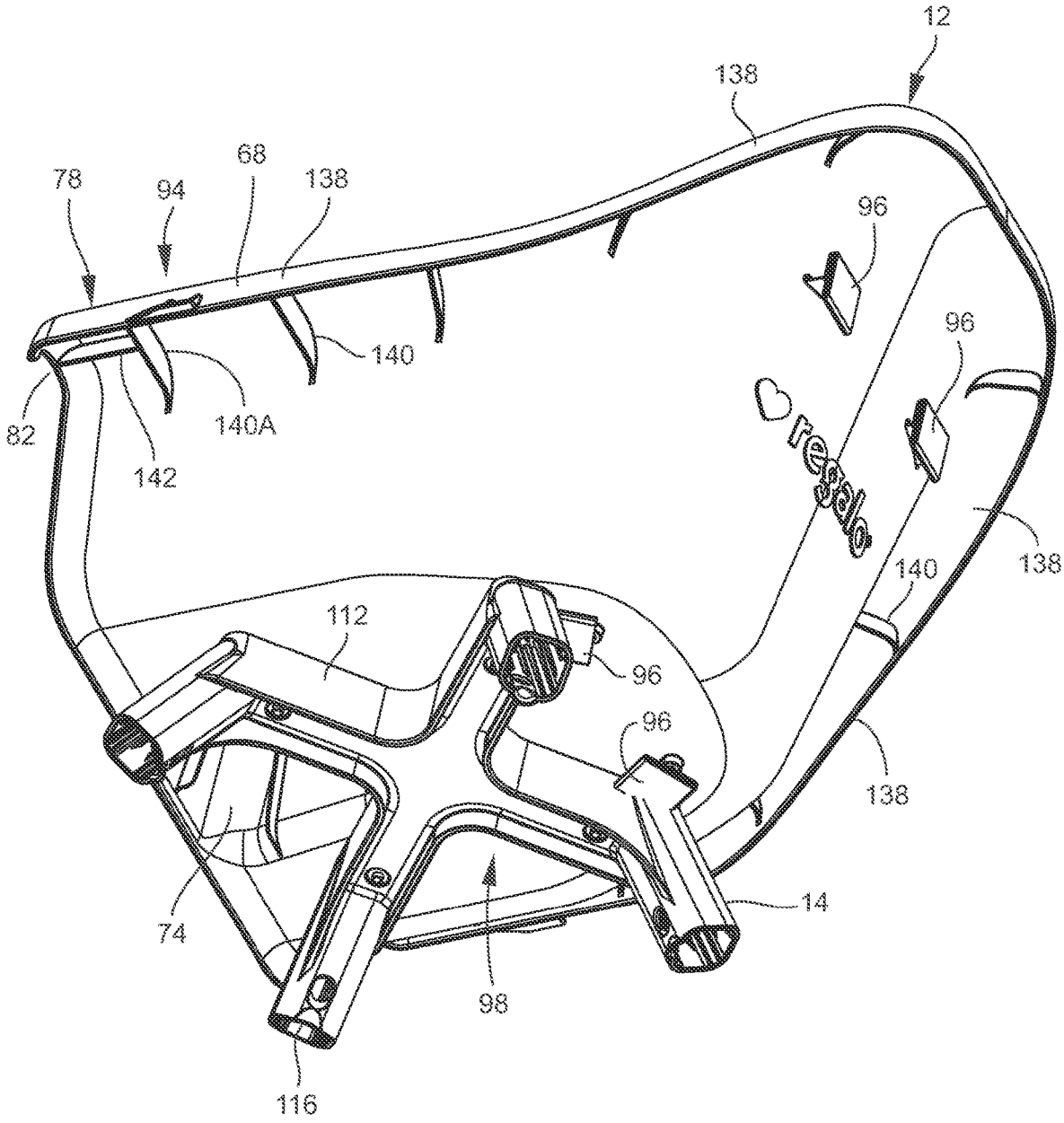
FIG. 14 is a bottom perspective view of the receptacle of the high chair apparatus of FIG. 1, where the receptacle is engaged to a base having receivers for legs of the high chair apparatus of FIG. 1.

FIG. 14 is a bottom perspective view of the receptacle 12, showing the receptacle 12 engaged to a base 98 having receivers 14 for the legs 16 of the high chair apparatus 10. FIG. 14 shows that the bottommost edge of the longitudinal rib 142 terminates at the uppermost edge of the open front end 82 such that when the extension 92 slides into the open front end 82 the extension 92 immediately engages the bottommost edge of the longitudinal rib 142. Then the extension 92 continues its entrance, where the extension 92 is confined by the U-shaped edge of the open front end 82 and further confined by the bottommost edge of the longitudinal rib 142. FIG. 14 shows that the front end of the ramp 94 is adjacent to the intersection of rib 140A and an outermost portion of peripheral portion 138. FIG. 14 shows the button depressor 116 with the tapering face.

FIG. 14 shows that the left side of the receptacle 12 includes a left arm rest 68 having a frontmost U-shaped edge defining the open front end 82, a longitudinally extending rib 142 depending from the left arm rest 68, a laterally extending rib 140A extending from the arm rest 68 and engaged to the longitudinally extending rib 142. The extension 92 engages the frontmost U-shaped edge and the longitudinally extending rib 142 when the tab 28 is engaged to the ramp 94. The front of the extension 92 at this time is adjacent to or abuts the laterally extending rib 140A.

FIG. 14 shows that receiver 78 has a proximal portion, such as the open front end 82, that the receiver 78 has a distal portion, such as lateral rib 140A, and that the ramp 94 has a rear end that is closer to the back portion of the receptacle 12 than the proximal or distal portion of the receiver 78.

Figure 15A:
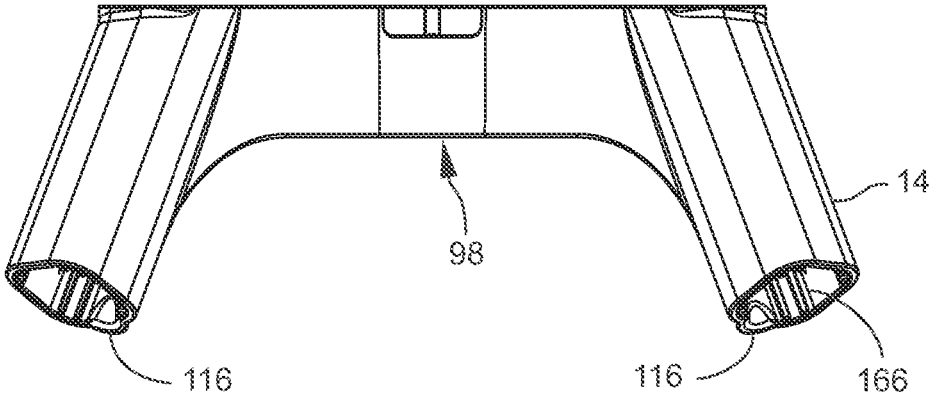
FIG. 15A is an isolated side view of the base of FIG. 14.
Figure 15B:
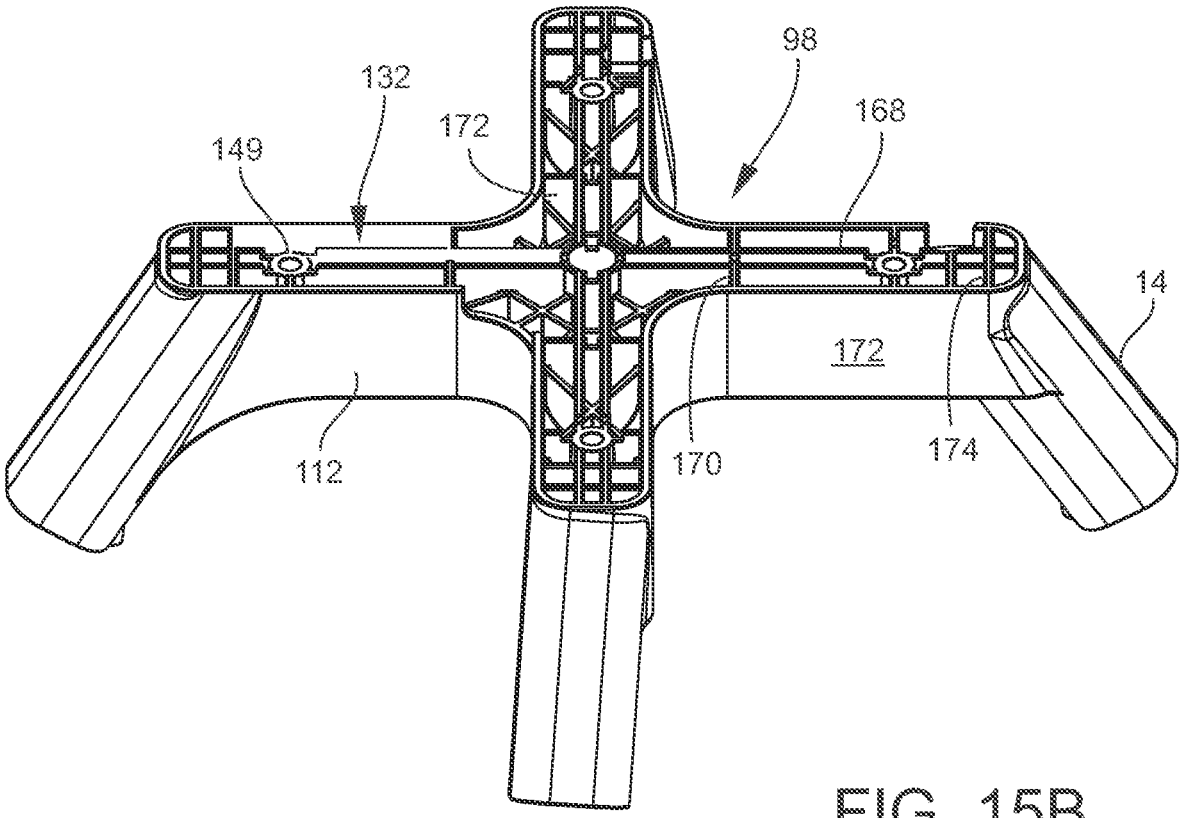
FIG. 15B is an isolated perspective view of the base of FIG. 14.

FIG. 15A is an isolated detail side view of the base 98. FIG. 15B is an isolated detail perspective view of the base 98. FIG. 15A shows the button depressor 116 that includes the tapering face to push the leg button 84 down into the leg 16. FIG. 15A shows adjacent parallel extending elongate ribs 166 on the inside of leg receptor 14 that work to reduce the inside diameter of leg receptor 14 such that leg 16 is received in leg receptor 14 snugly with minimal wobble. Elongate ribs 166 may extend the length of the leg receptor 14. FIG. 15B shows the open top portion 132 of the base 98. FIG. 15B shows that the base 98 includes internal ribs 168 that extend through the channels 112 and further extend into and to the leg receptors 14. Base 98 further include ribs 170 that extend to and between sidewalls 172 of the channels 112 and that further engage ribs 168. Base 98 further includes ribs 174 that engage ribs 168 and further engage leg receptors 14. Base 98 further include four inset pin receptors 149 for receiving bosses 146.

Figure 16A:
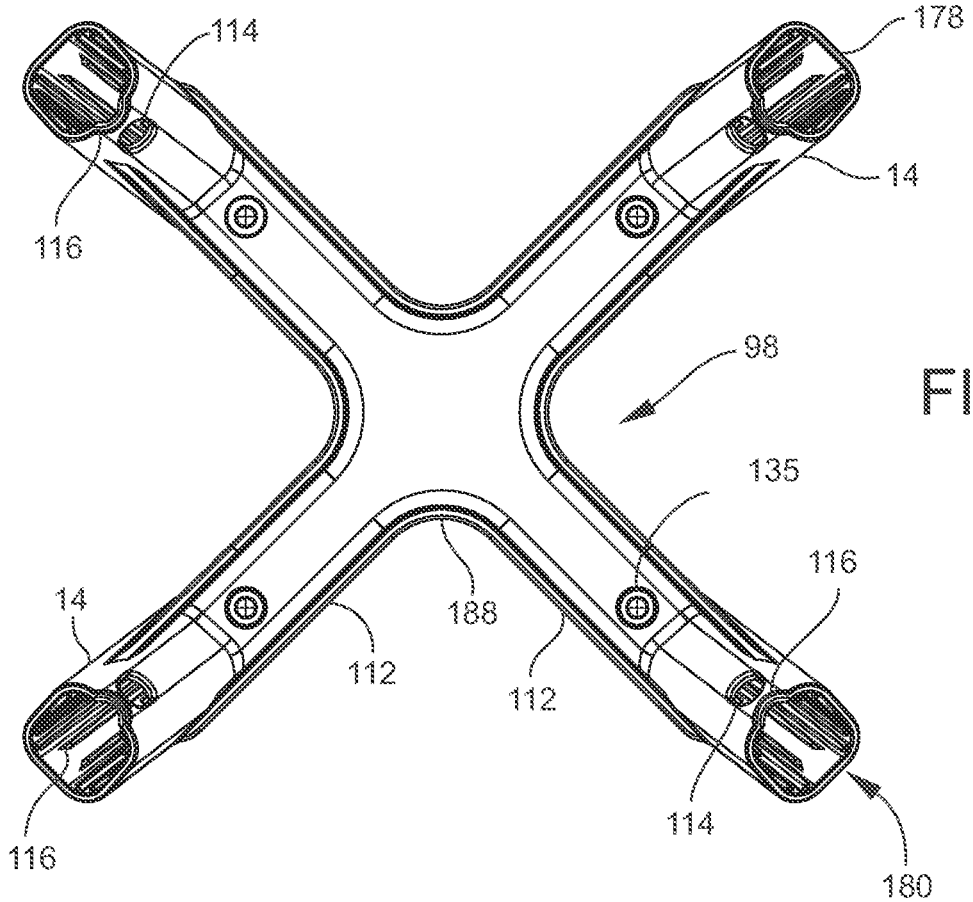
FIG. 16A is an isolated bottom view of the base of FIG. 14.
Figure 16B:
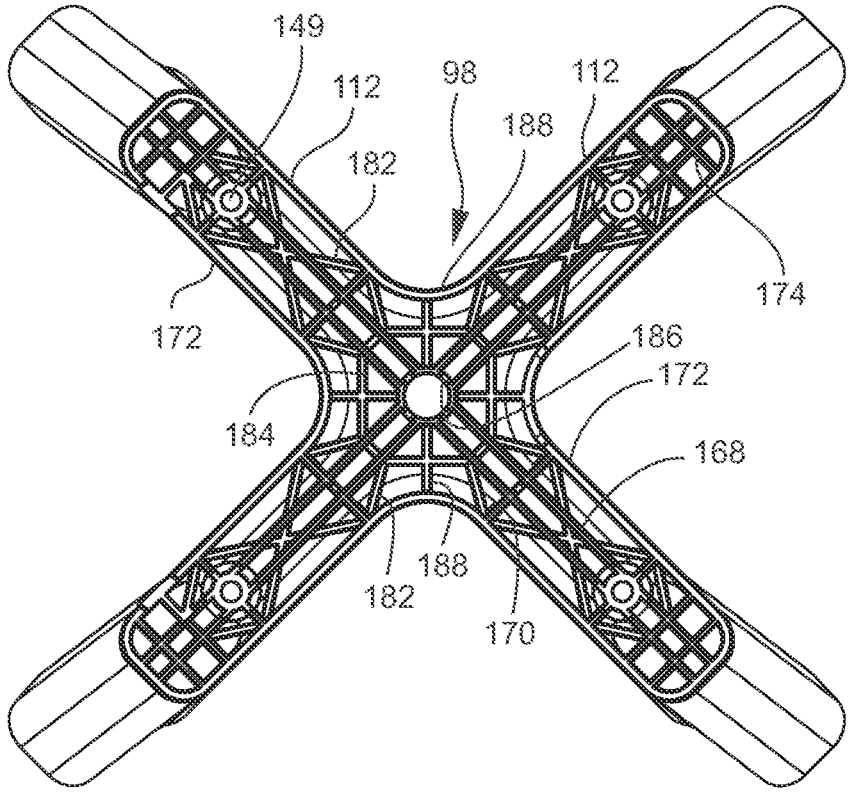
FIG. 16B is an isolated top view of the base of FIG. 14.

FIG. 16A is an isolated bottom view of the base 98. FIG. 16B is an isolated top view of the base 98. FIG. 16A shows the button depressor 116 that includes the tapering face to push the leg button 84 down into the leg 16. Leg receptor 14 includes an opening endless edge 178 that forms an opening 180 for accepting the leg 16. Button depressor 116 forms part of the opening endless edge 178 and is a visible clue for the user to oriented the leg 16 such that the button 84 is first engaged by the button depressor 116 and then engaged by the button opening 114 into which the button 84 snaps outwardly and into which the button 84 is locked. FIG. 16A show the elongate adjacent ribs 116 that serve to minimize wobble by the leg 16 when the leg 16 is engaged in the leg receptor 14.

FIG. 16B shows that base 98 includes longitudinal ribs 168 that run adjacent to and receive the crossing elongate members of the "X" structure 148, lateral ribs 170 engaged to sidewalls 172, lateral ribs 174 engaging opposing walls of the leg receptors 14, oblique ribs engaging opposing sidewalls 172, and an endless central rib 184 that engages four sets of longitudinal ribs 168 and that further engages oblique ribs 182.

FIG. 16B further shows that base 98 includes a cylindrical central rib 186 that engages radiating ribs 188. Radiating ribs 188 engage endless central rib 184 and cylindrical central rib 186. Cylindrical central rib 186 engages four sets of longitudinal ribs 168 and radiating ribs 188. FIG. 16B shows that sidewalls 112 have rounded junctions 188 and that ribs 188 extend from cylindrical rib 186 to the rounded junctions 188.

Figure 17:
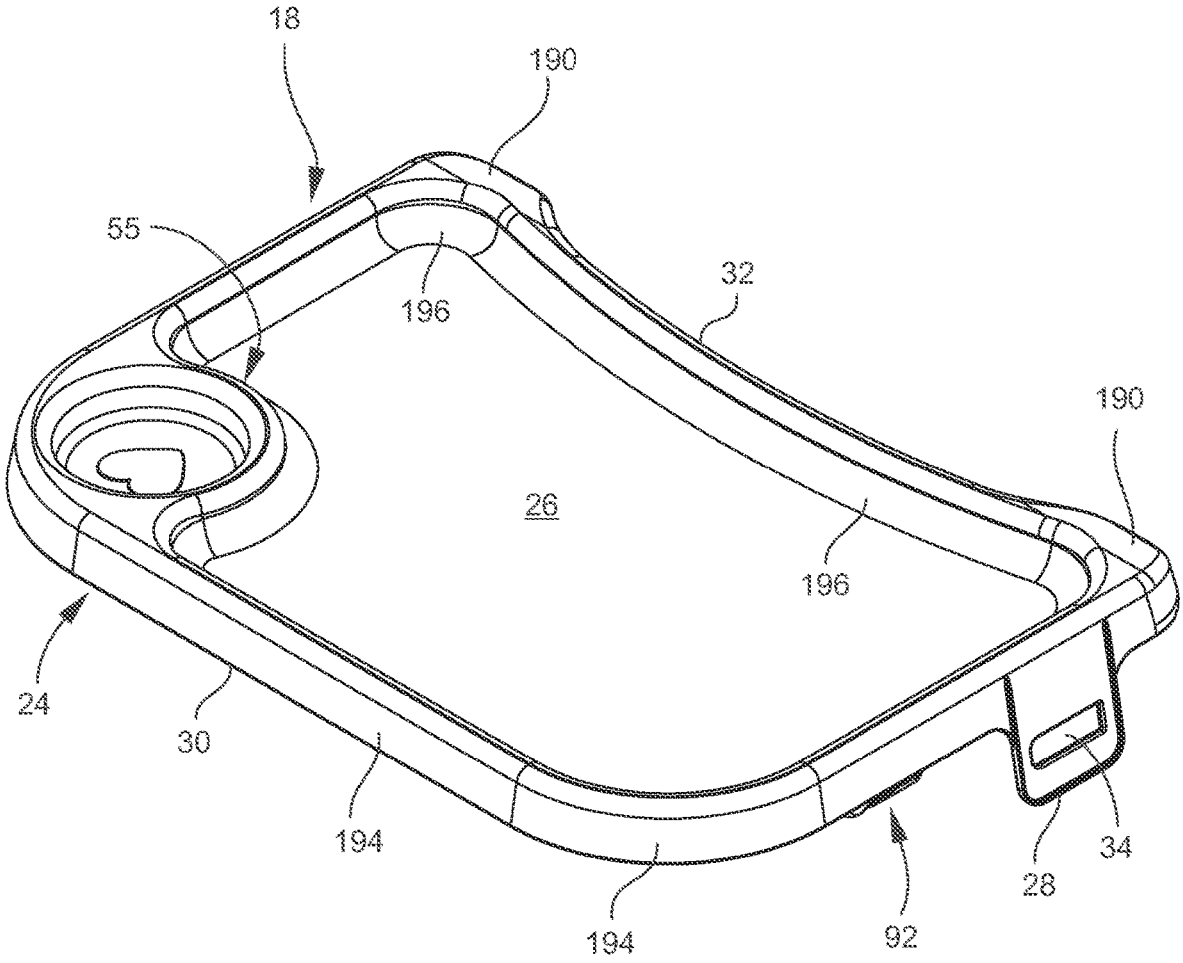
FIG. 17 is a perspective top view of the tray of the high chair apparatus of FIG. 1.

FIG. 17 is a perspective top view of the tray 18 of the high chair apparatus 10. Tray 18 includes a flat eating surface 26 that defines a plane. Tray 18 further includes a cup holder 55. Eating surface 26 and cup holder 55 are surrounded by endless periphery 24. Tray 18 includes a rear 30 and a front 32. FIG. 17 shows that tab 28 is integral and one-piece with tray 18. FIG. 17 shows that slot 34 is a through slot and extends in the longitudinal direction. Slot 34 is spaced from a bottommost edge of tab 28, and is further spaced from front and rear edges of the tab 28. FIG. 17 shows a portion of the extension 92. FIG. 17 shows that the periphery 24 includes flat corner portions 190 that define planes parallel to the eating surface 26.

Figure 18A:
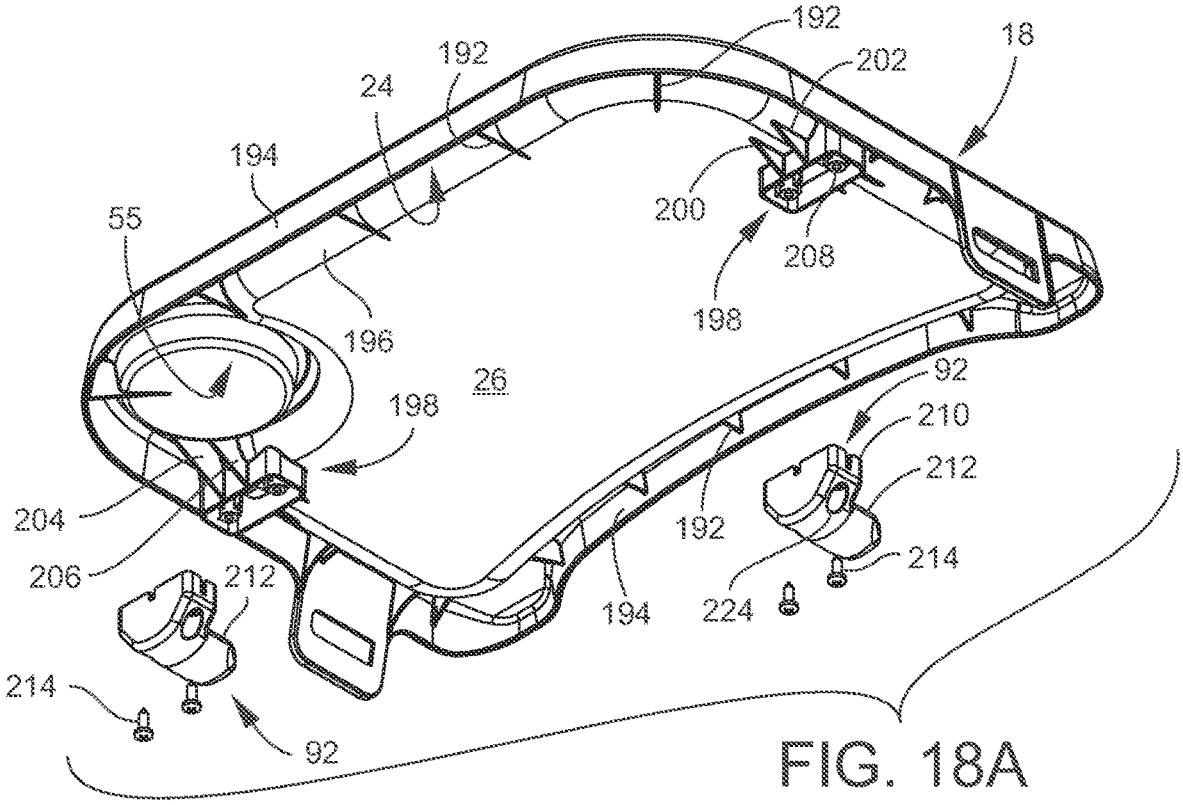
FIG. 18A is a perspective exploded bottom view of the tray of the high chair apparatus of FIG. 1.
Figure 18B:
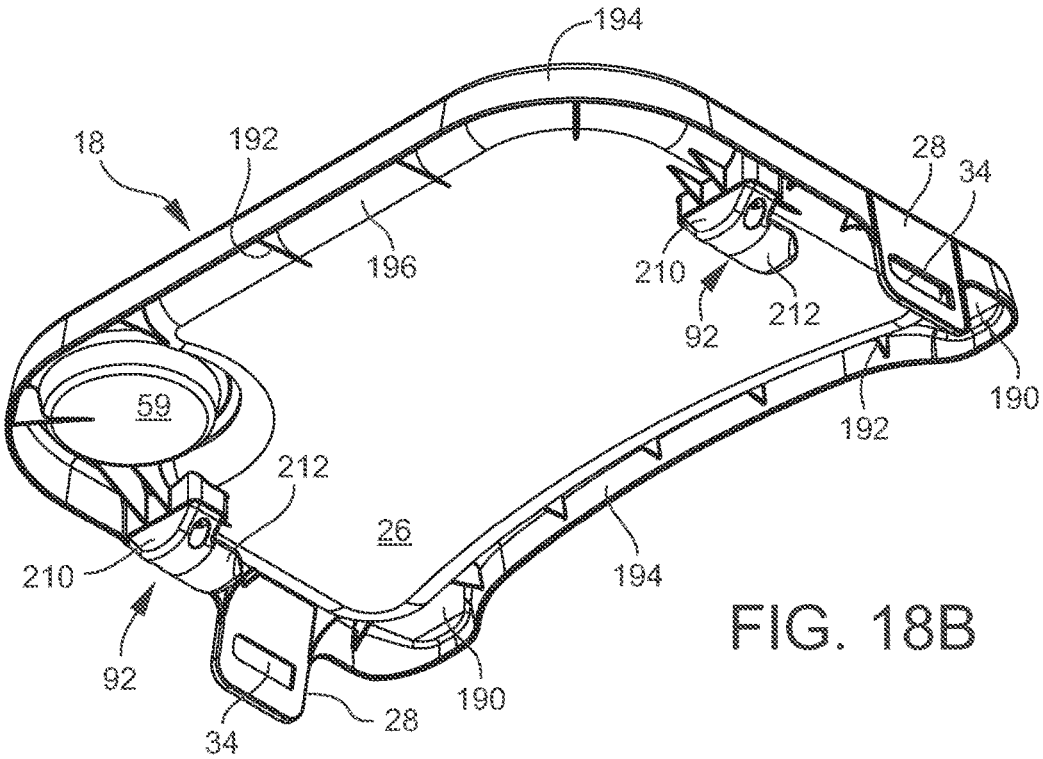
FIG. 18B is a perspective assembled bottom view of the tray of the high chair apparatus of FIG. 1.

FIG. 18A is a perspective exploded bottom view of the tray 18 of the high chair apparatus 10. FIG. 18B is a perspective assembled bottom view of the tray 18 of the high chair apparatus 10. FIGS. 18A and 18B show that endless periphery 24 is an inverted channel that surrounds the eating surface 26 and cup holder 55. The channeled periphery 24 is reinforced by a set of ribs 192 that extend at a right angle from an outer peripheral sidewall of the endless periphery 24 to an inner peripheral sidewall 196 of the endless periphery 24. Some of the ribs 192 further engage an underside of the eating surface 26.

FIGS. 18A and 18B show that tray 18 includes a mount 198 for the extension 92. Mount 198 is formed in the shape of a rectangular box having four sidewalls. The mount 198 is integral with the tray 18. One mount 198 extends downwardly from a portion of the eating surface 26 and a portion of the periphery 24. The other mount 198 extends downwardly from a portion of the eating surface 26, a portion of the periphery 24, and a portion of the cup holder 55. One mount 198 includes a first triangular brace 200 extending to the underside of the eating surface 24 and a second triangular brace 202 extending to the periphery 24. The other mount includes first and second triangular braces 204, 206 extending to the cup holder 55. Each of the mounts 198 includes therein first and second cylindrical pin receptors 208.

FIGS. 18A and 18B show the L-shaped extension 92 that engages mount 198. L-shaped extension 92 includes a box shaped portion 210 that engages mount 198 and an arm portion 212 that extends forwardly of the box shaped portion 210. Arm portion 212 slides into the open front ends 80, 82 and are received by the receivers 76, 78. Pin connectors 214 engage the box shaped portion 210 and then tie into the pin receptors 208 to engage the box shaped portion 210 to mount 198.

FIGS. 18A and 18B show that the bottommost edge of the tab 28 is disposed at a lower elevation than the bottommost portion of the outer peripheral wall 194, which bottommost portion of the outer peripheral wall 194 is adjacent to the tab 28.

FIGS. 18A and 18B show that an upper portion of box shaped portion 210 slides into and is received by mount 198. FIG. 18B shows the box shaped portion 210 in the mount 198. When the L-shaped extension 92 is engaged to mount 198, a lower portion of the box shaped portion 210 remains out of the mount 198 and the arm portion 212 remains out of the mount 198 as well.

Figure 19A:
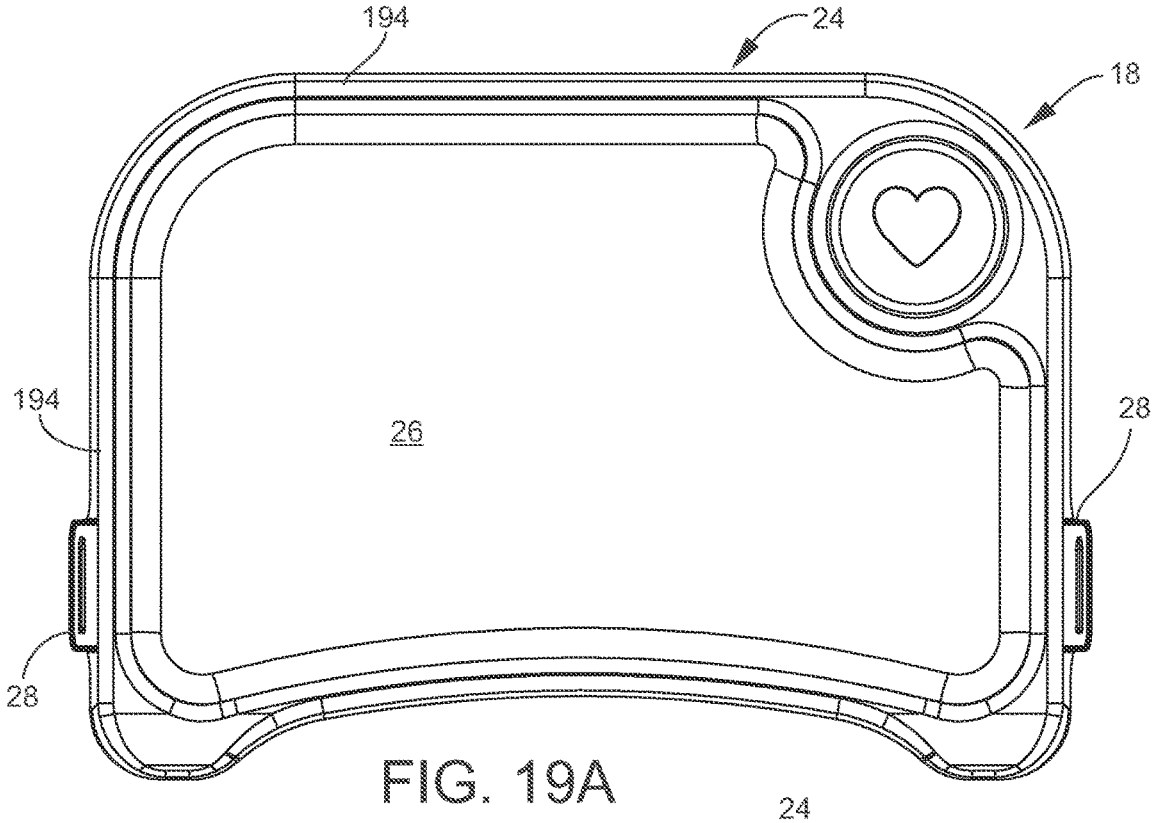
FIG. 19A is a top view of the tray of the high chair apparatus of FIG. 1.
Figure 19B:
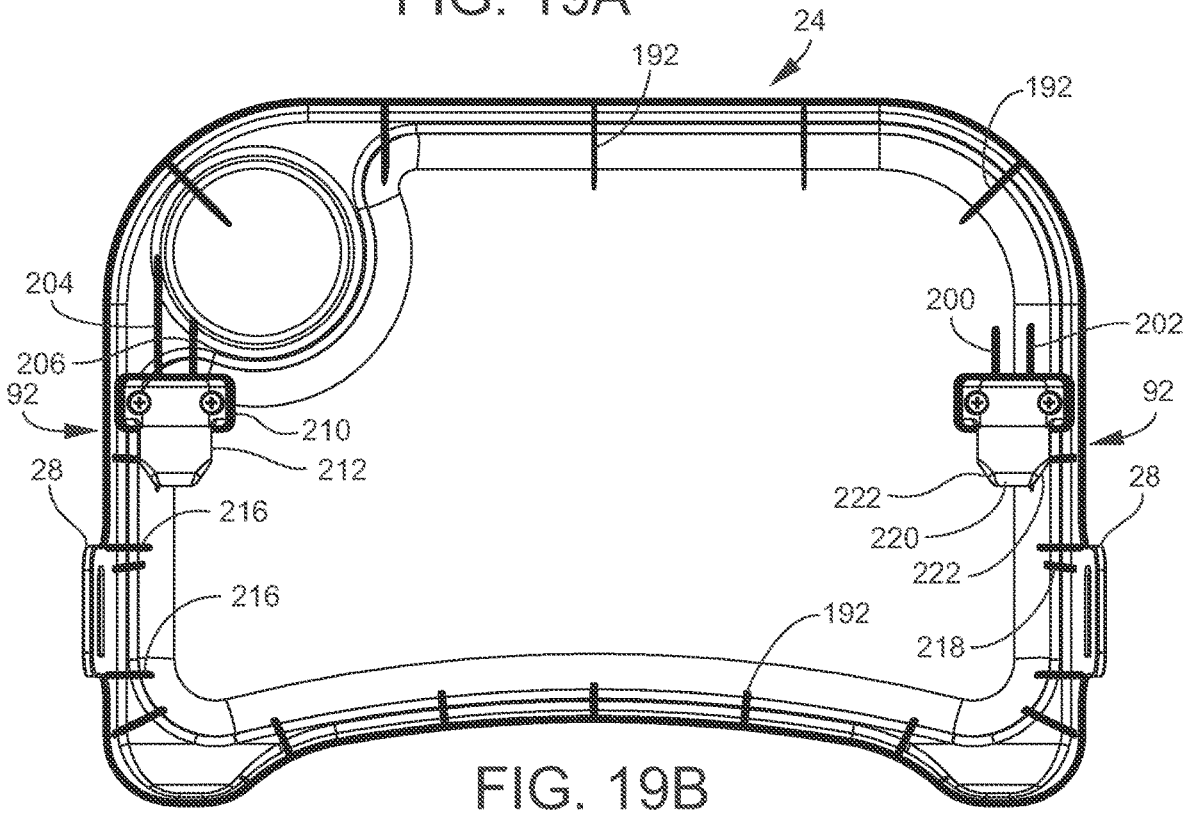
FIG. 19B is a bottom view of the tray of the high chair apparatus of FIG. 1.

FIG. 19A is a top view of the tray 18 of the high chair apparatus 10. FIG. 19B is a bottom view of the tray 18 of the high chair apparatus 10. Each of FIGS. 19A and 19B shows that tab 28 tapers downwardly and outwardly relative to the eating surface 26 that defines a plane.

FIG. 19B shows that first and second ribs 216 extend from the endless periphery 24 to outer edge portions of the tab 28 and that a third rib 218 extends from the endless periphery 24 to an intermediate portion of the tab 28. FIG. 19B shows that arm portion 212 of the extension 92 includes a front end 220 and tapered portions 222 extending outwardly and rearwardly from the front end 220 to guide the extension 92 through the open front ends 80, 82 and into the receivers 76, 78.

FIG. 19B shows that the extensions 92 are spaced from the outer wall 194 of the periphery 24. FIG. 19B shows that the extensions 92 are disposed inwardly of the tabs 28. FIGS. 19A and 19B show that outer wall 194 of the periphery 24 includes side portions and that these side portions of the outer wall 194 are co-planar with tabs 28.

FIG. 19B shows that the box shaped portion 210 of the extension 92 has a greater lateral width than does the arm portion 212. This box shaped portion 210 works as a stop that abuts the open front end 80 or 82 to stop the sliding into the receiver 76 or 78 of the arm portion 212.

FIGS. 19A and 19B show that the tray 18 includes a periphery 24 having a left side portion and a right side portion. Each of the left side portion and right side portion of the periphery 24 extends downwardly and outwardly. Each of the left side portion and right side portion of the periphery 24 includes a bottommost edge portion. The slot 34 of the tab 28 is defined in part by an uppermost edge portion and a lowermost edge portion. FIG. 24B shows that the lowermost edge portion of the slot 34 is below the bottommost edge portion of each of the left side portion and right side portion of the tray periphery 24 since the left side portion is identical to the right side portion.

FIGS. 19A and 19B show that the tray 18 includes a periphery 24 that includes a left side portion and a right side portion. Each of the left side portion and right side portion of the periphery 24 extends downwardly and outwardly in a respective plane. The extension 92 of a left engagement mechanism is disposed inside of the periphery 24. The extension 92 of a right engagement mechanism is disposed inside of the periphery 24. The tab 28 of the left side portion of the periphery 24 extends downwardly and outwardly in the plane of the left side portion of the tray periphery 24. The tab 28 of the right side portion of the tray periphery 24 extends downwardly and outwardly in the plane of the right side portion of the tray periphery 24.

Figure 20A:
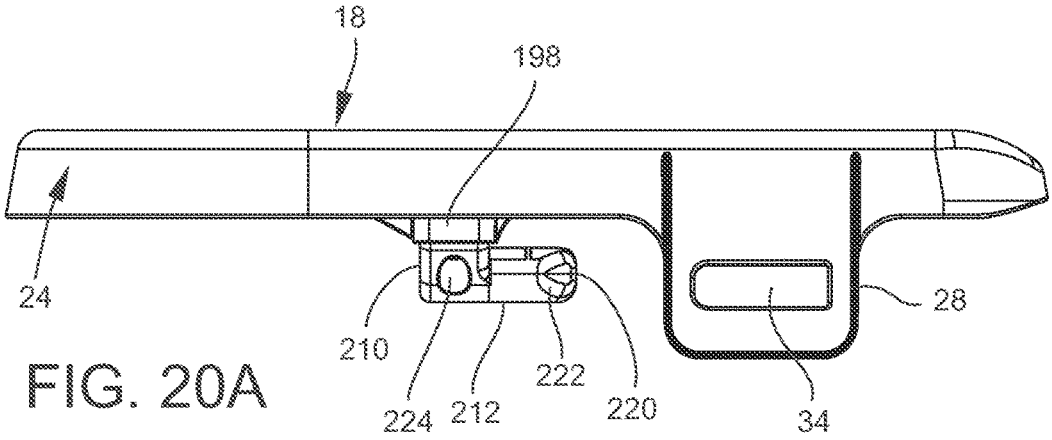
FIG. 20A is a side view of the tray of the high chair apparatus of FIG. 1.
Figure 20B:
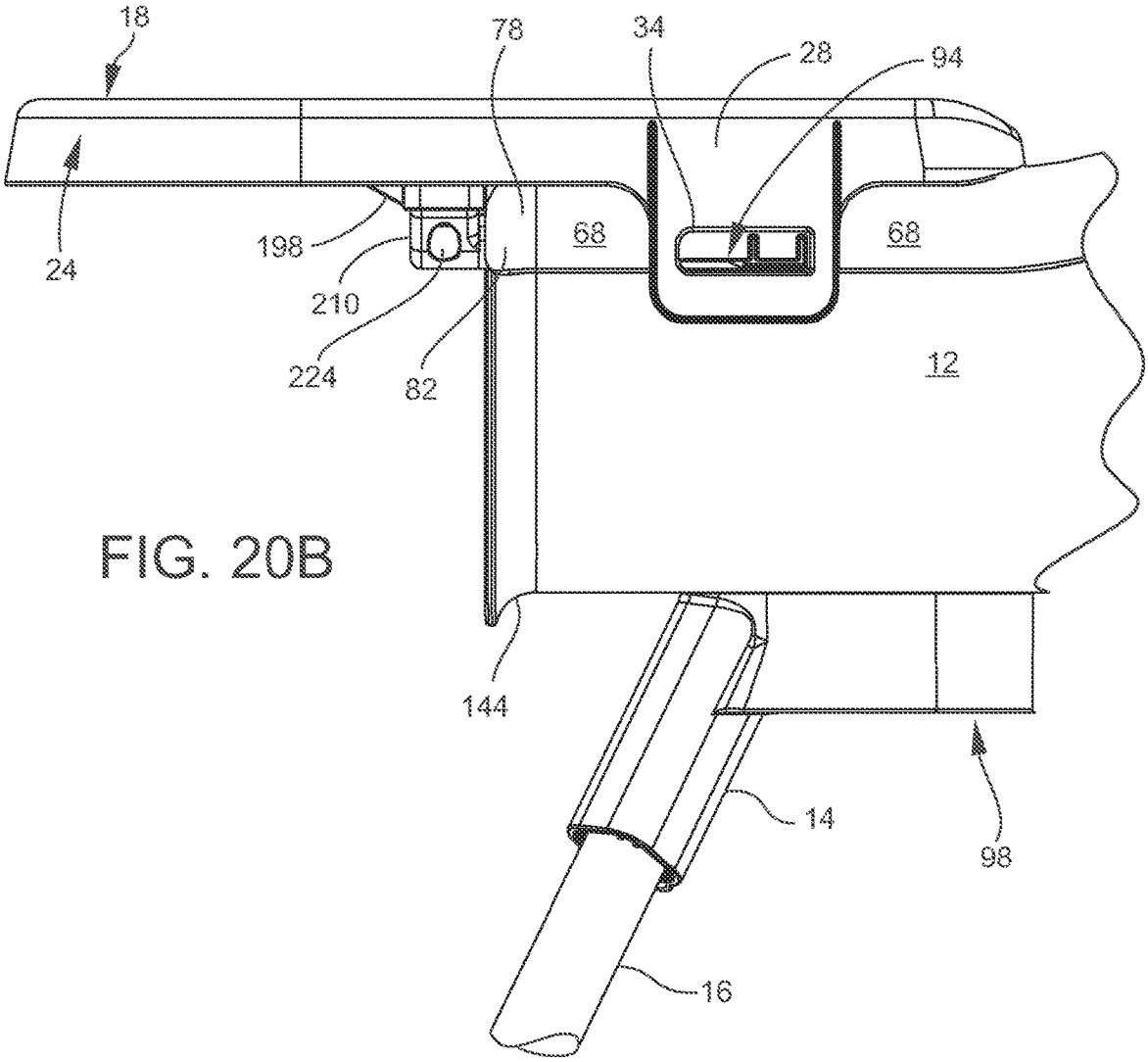
FIG. 20B is a side view of the tray of the high chair apparatus of FIG. 1 engaged to the receptacle of the high chair apparatus of FIG. 1.

FIG. 20A is a side isolated view of the tray 18 of the high chair apparatus 10. FIG. 20B is a side view of the tray 18 engaged to the receptacle 12. FIG. 20A shows the outer tapered portion or outer tapered face 222 of the extension 92. FIG. 20A shows that a longitudinal axis of the extension 92 is parallel to a longitudinal axis of the slot 34 of the tab 28. FIG. 20A shows that the front most portion of the extension 92 is disposed rearwardly of the back most portion of the tab 28. FIG. 20A shows that the bottommost portion of the tab 28 is disposed at a lower elevation than is the bottommost portion of the extension 92.

FIG. 20B shows that the arm portion 212 is substantially entirely in receiver 78 and that box shaped portion 210 is adjacent to the open front end 82 and, at the same time, ramp 92 is wholly received in slot 34 of tab 28. Reference number 224 in box shaped portion 210 is an inset for the head of pin 214. Inset 224 is also shown in FIGS. 18A and 18B.

FIG. 20A shows that tab 28 includes a bottommost tab edge, that the extension 92 includes a bottommost extension edge, and that the bottommost extension edge is disposed higher than the bottommost tab edge. FIG. 20A shows that extension 92 includes a frontmost end, that the tab 28 includes a rearmost end, and that the frontmost end of the extension 92 is disposed rearwardly of the rearmost end of the tab 28.

FIG. 20A shows that the slot 34 is defined in part by a slot front edge, and that the slot front edge engages the rear end of the ramp 94 when the tray 18 is fully engaged to the receptacle 12.

FIG. 20A shows that the tab 28 includes a distal portion and a proximal portion, that the distal portion of the extension 92 is closer to the rear portion of the tray 18 than the proximal portion of the tab 28.

FIGS. 20A and 20B show that a longitudinal length of the slot 34 is greater than a longitudinal length of the ramp 94 such that the tab 28 resiliently snaps back to an unflexed position when the slot 34 receives the ramp 94 to indicate audibly that the tab 28 has fully engaged the ramp 94.

FIGS. 20A and 20B show the receptacle 12 includes an arm rest 68 having a frontmost portion. The open front end 82 of the receiver 78 is disposed at the frontmost portion of the arm rest 68. The open front end 82 of the receiver 78 defines an entrance of the receiver 78 for the extension 92. The ramp 94 is on the arm rest 68 and extends outwardly therefrom. The receiver 78 includes an axis. The axis of the receiver 78 extends rearwardly and inside of the arm rest 68. The ramp 94 is on an outside of the arm rest 68. As shown in FIG. 9B, the ramp 94 includes a frontmost end, where the frontmost end is the point of the ramp 94 or first portion of the ramped edge 152. The frontmost end of the ramp 94 is opposite of the rear end of the ramp 94, where the rear end of the ramp 94 is the rib or brace 158.

FIGS. 20A and 20B show a distance from the frontmost end of the ramp 94 to the entrance of the receiver 78 is a first distance. The extension 92 includes a frontmost end and the tab 28 includes a rearmost end. A distance from the frontmost end of the extension 92 to the rearmost end of the tab 28 is a second distance. The second distance is less than the first distance such that the frontmost end of the extension 92 engages the entrance of the receiver 78 prior to the slot 34 engaging the ramp 94.

FIG. 21A is a perspective top view of the foot rest 20 of the high chair apparatus 10. FIG. 21B is a top view of the foot rest 20. FIG. 21C is a front view of the foot rest 20. FIG. 21D is a side view of the foot rest 20. FIG. 21E is a section view of the foot rest 20. FIGS. 21B and 21C show that the axes of the cylinder portions 108 taper away from each other. Thus, when the foot rest 20 is engaged to legs 16, the foot rest 20 can slide neither up nor down. Reference number 226 indicates a lower opening of cylinder 108, where the lower opening 226 is opposite of opening 40. Reference number 228 indicates a lower opening of cylinder 108, where lower opening 228 is opposite of opening 42.

FIGS. 4, 21A, 21B, 21C, 21D, and 21E show a receptacle 12 for a child. As shown in FIG. 2, the receptacle 12 includes a seat portion 60, a back portion 58, a left side portion 62, and a right side portion 66. The tray 18 is removably engaged to the receptacle 12. The tray 18 generally defines a first plane. First, second, third, and fourth legs 16 depend from the receptacle 12 for supporting the receptacle 12 relative to a floor or ground portion. Each of the first, second, third, and fourth legs 16 includes an upper portion and a lower portion. The foot rest 20 is engaged to first and second front legs 16. The foot rest 20 extends to and between the first and second front legs 16. The foot rest 20 generally defines a second plane parallel to the first plane generally defined by the tray 18. The foot rest 20 includes a first through opening, defined by a first cylinder 108, for receiving a first leg 16. The foot rest 20 includes a second through opening, defined by a second cylinder 108, for receiving the second leg. The first through opening and first cylinder 108 defines a first axis. The second through opening and second cylinder 108 defines a second axis. The first axis of the first opening and first cylinder 108 is oblique relative to the second plane. The second axis of the second opening and second cylinder 108 is oblique relative to the second plane. The first and second axes of the first and second openings of the first and second cylinders 108 taper away from each other. When the foot rest 20 is pushed downwardly, outer portions of the first and second cylinders 180 come under pressure from the first and second front legs 16 thereby limiting downward movement. When the foot rest 20 is pushed upwardly inner portions of the first and second cylinders 180 come under pressure from the first and second front legs 16 thereby limiting upward movement of the foot rest 20. The foot rest 20 is spaced from the tray 18 at a first distance. This first distance is determined by a straight line distance between the first and second axis of the first and second cylinders 108. The foot rest 20 includes a predefined height. The predefined height is determined by selecting an oblique angle between the first and second front legs 16 and by selecting a straight line distance between the first and second axis of the first and second openings of the first and second cylinders 108. The foot rest 20 is minimally slideable downwardly from the predefined height by virtue of the first and second front legs 16 being set obliquely relative to each other and received in the respective first and second through openings of the first and second cylinders 108 having endless sidewalls abutting the first and second front legs 16. The foot rest 10 is minimally slideable upwardly from the predefined height by virtue of the first and second front legs 16 being set obliquely relative to each other and received in respective first and second through openings of the first and second cylinders 108 having endless sidewalls abutting the first and second front legs 16. The first front leg 16 includes a first straight leg portion. The second front leg 16 includes a second straight leg portion. The first straight leg portion is engaged by the first through opening of the first cylinder 108. The second straight leg portion is engaged by the second through opening of the second cylinder 108. The first and second straight leg portions of the first and second front legs 16 extend obliquely relative to each other. It should be noted that each of the first, second, third, and fourth legs 16 includes an uppermost portion and a lowermost portion and that each of the first, second, third, and fourth legs 16 is straight from the uppermost portion to the lowermost portion.

Figure 22A:
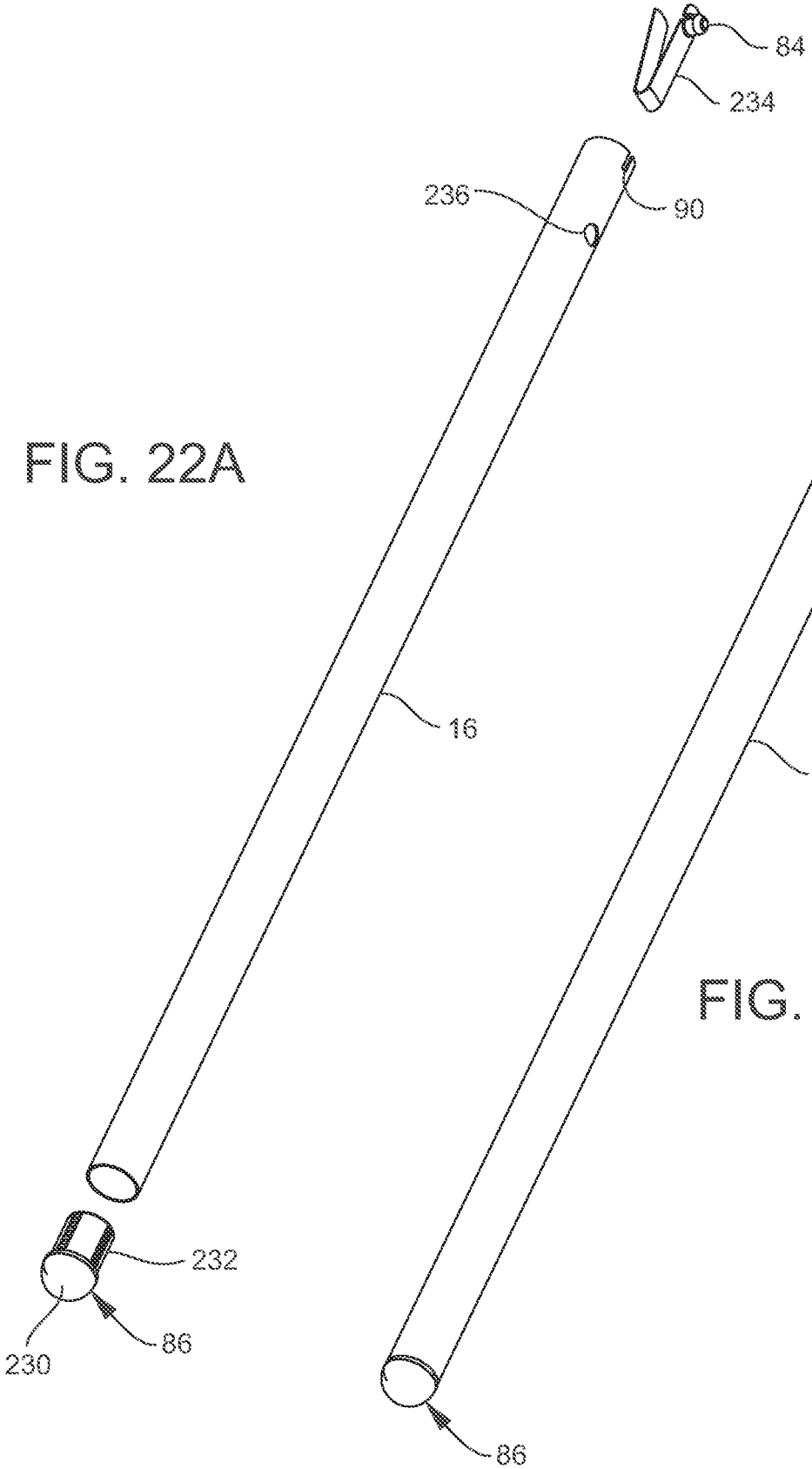
FIG. 22A is an exploded perspective view of a leg of the high chair apparatus of FIG. 1.
Figure 22B:
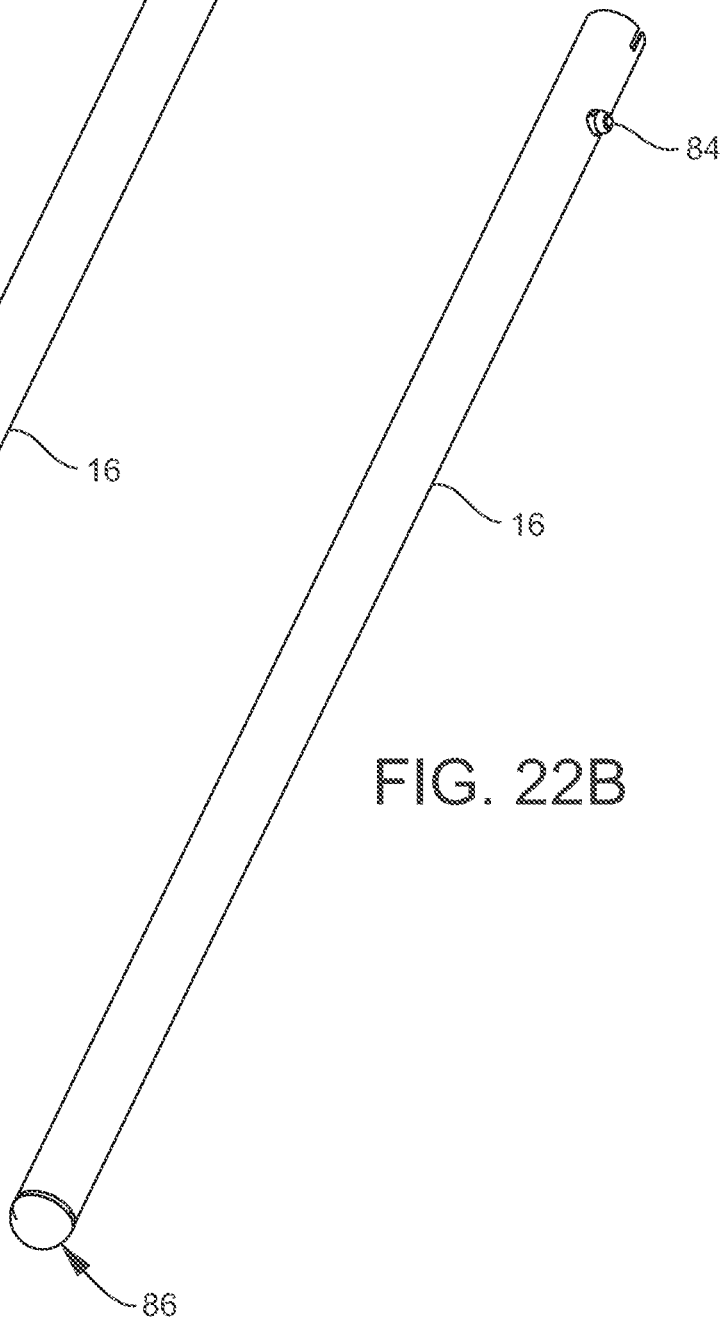
FIG. 22B is an assembled perspective view of the leg of FIG. 22A.

FIG. 22A is an exploded perspective view of one of the legs of the high chair apparatus 10. FIG. 22B is an assembled perspective view of the leg 16 of FIG. 22A. As indicated above, each of the bottom portions of the legs 16 includes inserted therein a plug 86 that is formed of rubber or an elastomer or other friction reducing, floor grabbing material to minimize sliding of the high chair apparatus 10, to grip a floor, and to minimize scratching of a floor surface. Plug 86 includes a spherical portion 230 and a cylindrical portion 232. Cylindrical portion 232 is roughened on its outer surface to friction fit within the lower portion of the tubular leg 16. The wider spherical portion 230 works as a stop to stop the insertion of the cylindrical portion 232 into the leg 16. Each of the legs 16 includes the spring biased button 84. Button 84 is one-piece with a V-shaped or U-shaped spring portion 234 that is set inside of the upper portion of leg 16. Button 84 engages and extends through button opening 236 and further extends into button opening 114 of leg receptor 14 to lock leg 16 in the leg receptor 14. Legs 16 are removable from their respective leg receptors 114 by depressing button 84 to make the top face of button 84 generally flush with the outer surface of leg 16 such that leg 16 may be withdrawn from its respective leg receptor 14.

FIGS. 22A and 22B shows that the upper ends of the legs 16 include diametrically opposite slots 90 that engage tabs in receivers 14 to orientate buttons 84 to engage button receptacles or openings 114 in the leg receivers 14.

Figure 23C:
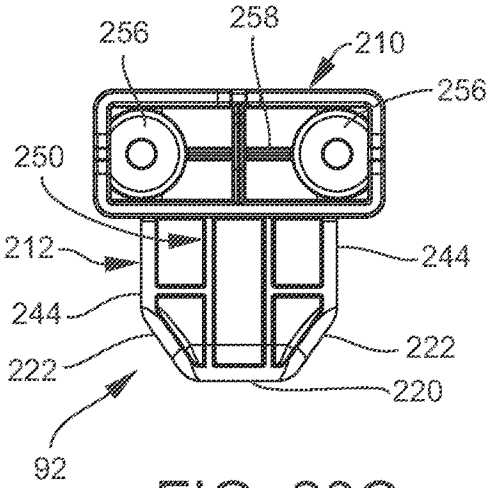
FIG. 23C is a top view of the extension of FIG. 23A.
Figure 23F:
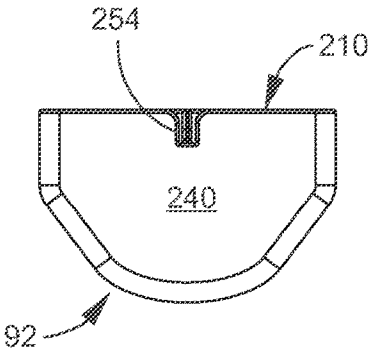
FIG. 23F is a rear view of the extension of FIG. 23A.
Figure 23B:
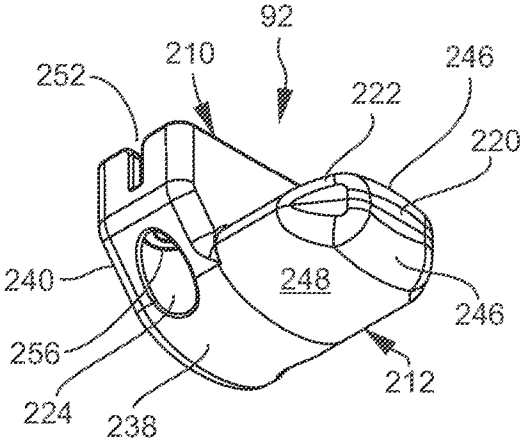
FIG. 23B is a bottom perspective view of the extension of FIG. 23A.
Figure 23E:
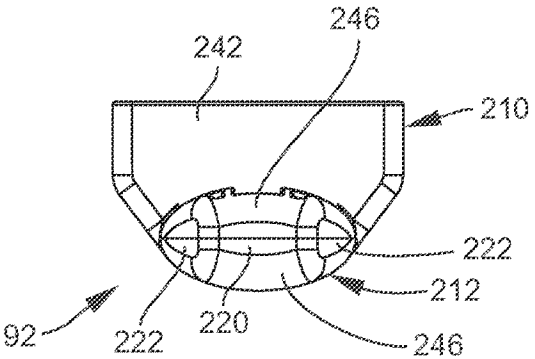
FIG. 23E is a front view of the extension of FIG. 23A.

FIGS. 23A, 23B, 23C, 23D, 23E, and 23F show the L-shaped extension 92 of the tray 18 that engages one of the receivers 76, 78 of the receptacle 12. FIGS. 23A, 23B, 23C, 23D, 23E, and 23F show the box shaped portion 210 of the extension 92. An upper portion of the box shaped portion 210 is parallelepiped in shaped. A lower portion of the box shaped portion 210 is U-shaped, as shown by FIGS. 23B and 23F, so as to include a lower U-shaped wall 238. Lower U-shaped wall 238 includes inset 224 for the heads of pin 214. Box shaped portion 210 includes a rear wall 240 shown in FIG. 23F. Box shaped portion 210 includes a front wall 242. Each of the front wall 242 and rear wall 240 extends from the top of the upper parallelepiped portion of the box shaped portion 210 to the bottom of the lower U-shaped portion of the box shaped portion 210.

FIGS. 23A, 23B, 23C, 23D, and 23E show the arm portion 212. Arm portion 212 is integral with and extends forwardly of the front wall 242. Arm portion 212 includes tapered portions or outer tapered faces 222. Each of the tapered portions 22 extends from a sidewall 244 to a front end 220 of the arm portion 212. Front end 220 includes its own upper and lower tapered faces 246. Upper and lower tapered faces 246 run into outer tapered faces 222. From the front end view of FIG. 23E, it can be appreciated that the front end 220, outer tapered faces 22, and upper and lower tapered faces 246 take on the shape of a football or ellipse. Arm portion 212 includes a lower U-shaped wall 248. For stiffening, arm portion 212 includes a set of laterally and longitudinally extending ribs 250 extending from front wall 242 to front end 220 and from one sidewall 244 to the opposite side wall 244. Ribs 250 also engage the lower U-shaped wall 248 of the arm portion 212. Ribs 250 further engage the upper and lower tapering faces 246.

Figure 23A:
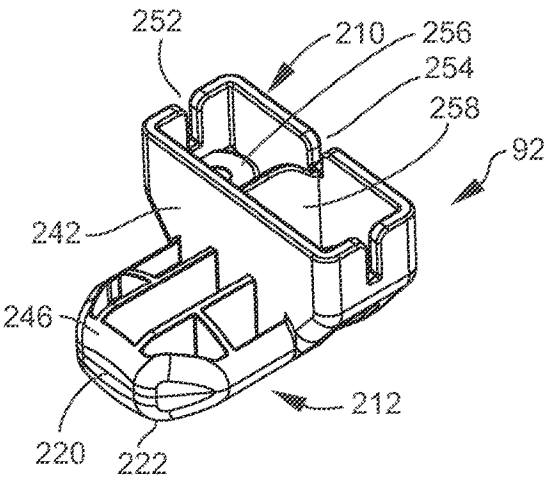
FIG. 23A is a detail isolated top perspective view of the extension of FIG. 3.
Figure 23D:
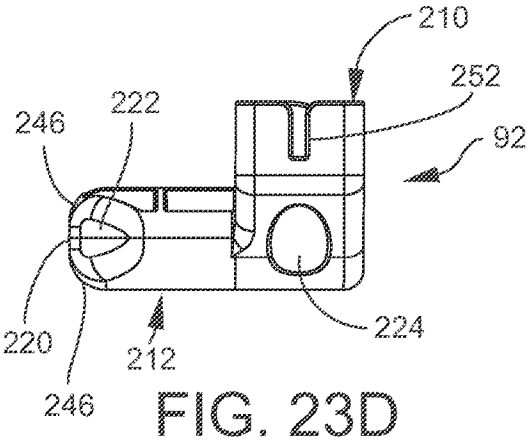
FIG. 23D is a side view of the extension of FIG. 23A.

FIGS. 23A, 23B, and 23D shows side slots 252 that engage tabs in the mount 198 for alignment after the upper portion of the box shaped portion 210 has been slid into the mount 198. FIGS. 23A and 23F show a rear slot 254 in rear wall 240 that also engages a tab in mount 198 for alignment of the mount 198 with the L-shaped extension 92. When L-shaped extension 92 is engaged in mount 198, pin receptor bosses 256 confront the bosses of pin receptors 208 of the mount 198.

FIGS. 23A and 23C show that the box shaped portion 210 has a laterally and longitudinally extending network of ribs 258 that engages front and rear walls 240, 242 and lower U-shaped wall 238.

In operation, to engage the tray 18 to the receptacle 12, the user makes the straight axis of the left extension 92 co-axial with the straight axis of the left open front end 80 and left receiver 76 and, at the same time, makes the straight axis of the right extension 92 co-axial with the straight axis of the right open front end 82 and right receiver 78. In other words, the user brings the front of the tray 18, with the tray 18 being horizontal, adjacent to the front portions of the left arm rest 66 and right arm rest 68.

Then the user slides the left extension 92 into the left open front end 80 and the left receiver 76 and, at the same time, the right extension 92 into the right open front end 82 and the right receiver 78. In other words, the user pushes the front of the tray 18 forwardly such that front underneath portions of the tray 18 slide on the left and right arm rests 66, 68.

At the same time that the left and right extensions 92 are being slid into the left and right receivers 76, 78, the left and right tabs 29 are being pushed over the left and right ramps 94 such that the left ramp 94 receives the slot 34 of the left tab 28 and such that the right ramp 94 receives the slot 34 of the right tab 28. Tabs 28 resiliently bend outwardly, being engaged by the ramps 94, when the extensions 92 are being slidingly inserted into the left and right receivers 76, 78.

It should be noted that the steps of a) making the straight axis of the left extension 92 co-axial with the straight axis of the left receiver 76 and the straight axis of the right extension 92 co-axial with the straight axis of the right receiver 78, then b) sliding the left extension 92 into the left receiver 76 and the right extension 92 into the right receiver 78 are necessary precursor steps to c) pushing the left tab 28 over the left ramp 94 such that the left ramp 94 receives the slot 34 of the left tab 28 and pushing the right tab 28 over the right ramp 94 such that the right ramp 94 receives the slot 34 of the right tab 28. Otherwise, structural integrity of at least one of the tray 18, high chair receptacle 12, left receiver 76, right receiver 78, left extension 92, right extension 92, left ramp 94, right ramp 94, left tab 28, and right tab 28 is destroyed by carrying out one of the steps of e) lowering the left and right tabs 28 downwardly upon the left and right ramps 94, f) raising the left and right tabs 28 upwardly upon the left and right ramps 94, g) pushing the left and right tabs 28 from a position in front of the left and right ramps 94 onto the left and right ramps 94 without carrying out the step of making the axes coaxial, and h) pushing the left and right tabs 28 from a position back of the left and right ramps 94 onto the left and right ramps 94. In other words, the structure of the high chair apparatus 10 does not permit the operation of steps "e" or "f" or "g" or "h" above.

In operation, to disengage the tray 18 from the receptacle 12, the user uses the fingers of his or her left hand and the fingers of his or her right hand to grip the bottommost edges of the left and right tabs 28 and resiliently bend the tabs 28 outwardly such that the slots 34 disengage from the ramps 94. Then the user slides the tray 18 rearwardly such that the extensions 92 slide out of the receivers 76, 78, whereupon the tray 18 can be lifted upwardly or moved downwardly or moved left or moved right or some combination of such. Then the child can be lifted out of the receptacle 12.

Between the steps of engaging the tray 18 to the receptacle 12 and disengaging the tray 18 from the receptacle 12, the tray 18 stays engaged in a sturdy manner on the receptacle 12. In this sturdy engagement, a long elongate portion of the periphery 24 of the tray 18 rests upon a long elongate portion of the arm rests 66, 68. Further, the first engagement between the extensions 92 and receivers 76, 78 and the second engagement between the slots 34 and their respective ramps 94 minimize or outright eliminate a) a side to side movement of the tray 18 relative to the receptacle 12 along a lateral axis, b) an up and down movement of the tray 18 relative to the receptacle 12 along a vertical, c) a forward and back movement of the tray 18 relative to the receptacle 12 along a longitudinal axis, d) a tilting of the tray 18 relative to the receptacle 12 about a horizontal axis, and e) a tilting of the tray 18 relative to the receptacle about a longitudinal axis.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A high chair apparatus, comprising:

a) a receptacle for a child, the receptacle having a seat portion, a back portion, a left side portion, and a right side portion;

b) legs depending from the receptacle for supporting the receptacle relative to a floor or ground portion, each of the legs having an upper portion and a lower portion;

c) a tray removably engaged to the receptacle, the tray having a front and a rear; and d) left and right engagement mechanisms between the tray and the receptacle, the left engagement mechanism being between the tray and the left side portion of the receptacle, the right engagement mechanism being between the tray and the right side portion of the receptacle, each of the left and right engagement mechanisms comprising:

i) a receiver integral and one-piece with the receptacle, the receiver having an open front end;

ii) a ramp engaged to the receptacle, the ramp being integral and one-piece with the receptacle, the ramp extending outwardly from the receptacle, the ramp having a ramped outer edge, the ramp further having a rear end;

iii) an extension engaged to the tray, the extension extending in a direction from the rear of the tray to the front of the tray, the extension having a distal end and a proximal end, the distal end of the extension being engaged to the tray, the proximal end of the extension being spaced from the tray, the distal end of the extension being closer to the rear of the tray than is the proximal end of the extension;

iv) a tab resiliently engaged to the tray, the tab extending downwardly and outwardly from the tray when the tab is unflexed, the tab extending obliquely from the tray when the tab is unflexed, the tab extending longitudinally in a direction from the rear of the tray to the front of the tray, the tab having a slot, the slot being a through slot, the slot extending laterally through the tab;

v) wherein the extension of the tray slidably and removably engages the receiver of the receptacle; and vi) wherein the tab of the tray slidably, resiliently, and removably engages the ramp of the receptacle when the extension of the tray slides into the receiver of the receptacle and the slot receives the ramp;

e) the high chair apparatus having structure to deny access of the ramp to the slot unless the extension is in the receiver or unless an integrity of said structure is destroyed; and f) wherein each of the left and right side portions of the receptacle includes:

i) an arm rest having a frontmost U-shaped edge;

ii) a longitudinally extending rib depending from the arm rest;

iii) a laterally extending rib extending from the arm rest and engaged to the longitudinally extending rib; and iv) the extension engaging the frontmost U-shaped edge and longitudinally extending rib when the tab is engaged to the ramp.

2. The high chair apparatus of claim 1, wherein the tab includes a bottommost tab edge, wherein the extension includes a bottommost extension edge, and wherein the bottommost extension edge is disposed higher than the bottommost tab edge.

3. The high chair apparatus of claim 1, wherein the extension includes a frontmost end, wherein the tab includes a rearmost end, and wherein the frontmost end of the extension is disposed rearwardly of the rearmost end of the tab.

4. The high chair apparatus of claim 1, wherein the left side portion of the receptacle includes a left arm rest, wherein the right side portion of the receptacle includes a right arm rest, wherein the receiver of the left engagement mechanism is adjacent to the left arm rest, and wherein the receiver of the right engagement mechanism is adjacent to the right arm rest.

5. The high chair apparatus of claim 1, wherein the slot is defined in part by a slot front edge, the slot front edge engaging the rear end of the ramp when the tray is fully engaged to the receptacle.

6. The high chair apparatus of claim 1, wherein the tab includes a distal portion and a proximal portion, and wherein the distal end of the extension is closer to the rear of the tray than is the proximal portion of the tab.

7. The high chair apparatus of claim 1, wherein the receiver has a proximal portion and a distal portion, and wherein the rear end of the ramp is closer to the back portion of the receptacle than is the proximal portion of the receiver.

8. The high chair apparatus of claim 1, wherein the ramp includes a distal portion and a proximal portion, and wherein the ramped outer edge tapers outwardly and rearwardly from the proximal portion.

9. The high chair apparatus of claim 1, wherein the tab is resiliently bendable outwardly.

10. The high chair apparatus of claim 1, wherein the tab resiliently bends outwardly when the extension is inserted into the receiver, the tab being resiliently bent outwardly when engaged by the ramp.

11. The high chair apparatus of claim 1, wherein a longitudinal length of the slot is greater than a longitudinal length of the ramp such that the tab resiliently snaps back to an unflexed position when the slot receives the ramp to indicate audibly that the tab has fully engaged the ramp.

12. The high chair apparatus of claim 1, wherein:

a) the tray includes a periphery having a left side portion and a right side portion, each of the left side portion and right side portion extending downwardly and outwardly, each of the left side portion and right side portion having a bottommost edge portion;

b) the slot being defined in part by an uppermost edge portion and a lowermost edge portion; and c) the lowermost edge portion of the slot being below the bottommost edge portion of each of the left side portion and right side portion of the periphery.

13. The high chair apparatus of claim 1, wherein:

a) the tray includes a periphery having a left side portion and a right side portion, each of the left side portion and right side portion of the periphery extending downwardly and outwardly in a respective plane;

b) the extension of the left engagement mechanism is disposed inside of the periphery;

c) the extension of the right engagement mechanism is disposed inside of the periphery;

d) the tab of the left side portion of the periphery extends downwardly and outwardly in the plane of the left side portion of the periphery; and e) the tab of the right side portion of the periphery extends downwardly and outwardly in the plane of the right side portion of the periphery.

14. The high chair apparatus of claim 1, wherein:

a) the receptacle includes an arm rest portion having a frontmost portion, the open front end of the receiver being disposed at the frontmost portion of the arm rest portion, the open front end of the receiver defining an entrance of the receiver for the extension;

b) the ramp being on the arm rest portion and extending outwardly therefrom;

c) the receiver having an axis, the axis of the receiver extending rearwardly and inside of the arm rest portion, the ramp being on an outside of the arm rest portion;

d) the ramp including a frontmost end opposite of the rear end of the ramp;

e) a distance from the frontmost end of the ramp to the entrance of the receiver being a first distance;

f) the extension having a frontmost end and the tab having a rearmost end;

g) a distance from the frontmost end of the extension to the rearmost end of the tab being a second distance; and h) wherein the second distance is less than the first distance such that the frontmost end of the extension engages the entrance prior to the slot engaging the ramp.

15. A high chair apparatus, comprising:

a) a receptacle for a child, the receptacle having a seat portion, a back portion, a left side portion, and a right side portion;

b) a tray removably engaged to the receptacle, the tray generally defining a first plane;

c) first, second, third, and fourth legs depending from the receptacle for supporting the receptacle relative to a floor or ground portion, each of the first, second, third, and fourth legs having an upper portion and a lower portion;

d) a foot rest engaged to first and second legs, the foot rest extending to and between the first and second legs, the foot rest generally defining a second plane parallel to the first plane generally defined by the tray, the foot rest having a first through opening for receiving the first leg, the foot rest having a second through opening for receiving the second leg, the first through opening defining a first axis, the second through opening defining a second axis, the first axis being oblique relative to the second plane, the second axis being oblique relative to the second plane, the first and second axes tapering away from each other;

e) wherein the first through opening includes a first cylinder having the first axis and wherein the second through opening includes a second cylinder having the second axis such that 1) when the foot rest is pushed downwardly outer portions of the first and second cylinders come under pressure from the first and second legs thereby limiting downward movement and 2) when the foot rest is pushed upwardly inner portions of the first and second cylinders come under pressure from the first and second legs thereby limiting upward movement of the foot rest; and f) each of the first and second legs including a continuous, uninterrupted cylindrical outer surface at a region of engagement with the first and second cylinders, respectively, such that the first and second cylinders engage solely said continuous, uninterrupted cylindrical outer surfaces of said first and second legs, respectively.

16. A method for engaging a tray to a high chair receptacle, the high chair receptacle comprising a left receiver having a straight axis and a right receiver having a straight axis, the tray comprising a left extension having a straight axis and a right extension having a straight axis, the high chair receptacle further comprising a left ramp and a right ramp, the tray further comprising a left tab with a slot and a right tab with a slot, the method comprising the steps of:

a) making the straight axis of the left extension co-axial with the straight axis of the left receiver and the straight axis of the right extension co-axial with the straight axis of the right receiver; then b) sliding the left extension into the left receiver along said straight axes of said left extension and left receiver and the right extension into the right receiver along said straight axes of said right extension and right receiver, said straight axes being horizontal; then c) pushing the left tab over the left ramp such that the left ramp receives the slot of the left tab and pushing the right tab over the right ramp such that the right ramp receives the slot of the right tab; and d) the steps of making and sliding being necessary precursor steps to the step of pushing such that structural integrity of at least one of the tray, high chair receptacle, left receiver, right receiver, left extension, right extension, left ramp, right ramp, left tab, and right tab is destroyed by carrying out one of the steps of e) lowering the left and right tabs downwardly upon the left and right ramps, f) raising the left and right tabs upwardly upon the left and right ramps, g) pushing the left and right tabs from a position in front of the left and right ramps onto the left and right ramps without carrying out the step of making, and h) pushing the left and right tabs from a position back of the left and right ramps onto the left and right ramps.

17. A high chair apparatus, comprising:

a) a receptacle for a child, the receptacle having a seat portion, a back portion, a left side portion, and a right side portion;

b) legs depending from the receptacle for supporting the receptacle relative to a floor or ground portion, each of the legs having an upper portion and a lower portion;

c) a tray removably engaged to the receptacle, the tray having a front and a rear; and d) left and right engagement mechanisms between the tray and the receptacle, the left engagement mechanism being between the tray and the left side portion of the receptacle, the right engagement mechanism being between the tray and the right side portion of the receptacle, each of the left and right engagement mechanisms comprising:

i) a receiver integral and one-piece with the receptacle, the receiver having an open front end;

ii) a ramp engaged to the receptacle, the ramp being integral and one-piece with the receptacle, the ramp extending outwardly from the receptacle, the ramp having a ramped outer edge, the ramp further having a rear end;

iii) an extension engaged to the tray, the extension extending in a direction from the rear of the tray to the front of the tray, the extension having a distal end and a proximal end, the distal end of the extension being engaged to the tray, the proximal end of the extension being spaced from the tray, the distal end of the extension being closer to the rear of the tray than is the proximal end of the extension;

iv) a tab resiliently engaged to the tray, the tab extending downwardly and outwardly from the tray when the tab is unflexed, the tab extending obliquely from the tray when the tab is unflexed, the tab extending longitudinally in a direction from the rear of the tray to the front of the tray, the tab having a slot, the slot being a through slot, the slot extending laterally through the tab;

v) wherein the extension of the tray slidably and removably engages the receiver of the receptacle; and vi) wherein the tab of the tray slidably, resiliently, and removably engages the ramp of the receptacle when the extension of the tray slides into the receiver of the receptacle and the slot receives the ramp;

e) the high chair apparatus having structure to deny access of the ramp to the slot unless the extension is in the receiver or unless an integrity of said structure is destroyed; and f) wherein the ramp includes a floor, a first laterally extending rib, and a second laterally extending rib, the floor having the ramped outer edge, the first laterally extending rib extending from the floor of the ramp to the receptacle, and the second laterally extending rib extending from the floor of the ramp to the receptacle, and each of the first and second laterally extending ribs being receivable in the slot.

* * * * *